US008907875B1

(12) United States Patent
Yamashita et al.

(10) Patent No.: US 8,907,875 B1
(45) Date of Patent: Dec. 9, 2014

(54) PIXEL CIRCUIT, DISPLAY AND DRIVING METHOD THEREOF

(71) Applicant: Sony Corporation, Tokyo (JP)

(72) Inventors: Junichi Yamashita, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 14/459,454

(22) Filed: Aug. 14, 2014

Related U.S. Application Data

(63) Continuation of application No. 13/064,677, filed on Apr. 8, 2011, which is a continuation of application No. 11/338,631, filed on Jan. 25, 2006, now Pat. No. 7,948,456.

(30) Foreign Application Priority Data

Feb. 2, 2005 (JP) ..... 2005-027028

(51) Int. Cl.
*G09G 3/30* (2006.01)
*G09G 3/32* (2006.01)

(52) U.S. Cl.
CPC ..... *G09G 3/3233* (2013.01); *G09G 2300/0819* (2013.01); *G09G 2320/045* (2013.01)
USPC ..... 345/76; 345/77; 345/82; 315/169.1; 315/169.3

(58) Field of Classification Search
CPC ..... G09G 2300/0439; G09G 2300/046; G09G 2300/0842; G09G 2300/043; G09G 3/3688; G09G 3/3692; G09G 2320/0276
USPC ..... 345/76–82; 315/169.1–169.3
See application file for complete search history.

(56) References Cited

U.S. PATENT DOCUMENTS

| | | | | |
|---|---|---|---|---|
| 6,356,029 | B1 | 3/2002 | Hunter | |
| 6,693,388 | B2 | 2/2004 | Oomura | |
| 6,841,948 | B2 * | 1/2005 | Yoshida | 315/169.3 |
| 7,027,014 | B2 * | 4/2006 | Sato et al. | 345/76 |
| 7,173,590 | B2 | 2/2007 | Uchino et al. | |

(Continued)

FOREIGN PATENT DOCUMENTS

| | | | |
|---|---|---|---|
| JP | 2003-255856 | A | 9/2003 |
| JP | 2003-271095 | A | 9/2003 |

(Continued)

OTHER PUBLICATIONS

Japanese Office Action issued Feb. 15, 2011 for corresponding Japanese Application No. 2005-027028.

(Continued)

*Primary Examiner* — Jennifer Nguyen
(74) *Attorney, Agent, or Firm* — Rader, Fishman & Grauer PLLC

(57) ABSTRACT

The invention provides a pixel circuit that can cancel the influence of the mobility of a drive transistor. A drive transistor supplies a light-emitting element with an output current dependent upon an input voltage. The light-emitting element emits light with a luminance dependent upon a video signal in response to the output current supplied from the drive transistor. The pixel circuit includes a correction unit that corrects the input voltage held by a capacitive part in order to cancel the dependence of the output current on the carrier mobility.

3 Claims, 16 Drawing Sheets

(56) References Cited

U.S. PATENT DOCUMENTS

| | | | | |
|---|---|---|---|---|
| 7,605,789 | B2 | 10/2009 | Uchino et al. | |
| 7,659,872 | B2 | 2/2010 | Yamashita et al. | |
| 7,974,456 | B2 | 7/2011 | Lee et al. | |
| 2003/0137503 | A1 | 7/2003 | Kimura et al. | |
| 2005/0012736 | A1* | 1/2005 | Uchino et al. | 345/211 |
| 2005/0206590 | A1 | 9/2005 | Sasaki et al. | |
| 2007/0247399 | A1 | 10/2007 | Yamashita et al. | |

FOREIGN PATENT DOCUMENTS

| | | | |
|---|---|---|---|
| JP | 2004-029791 | A | 1/2004 |
| JP | 2004-093682 | A | 3/2004 |
| JP | 2004-133240 | A | 4/2004 |
| JP | 2004-280059 | A | 10/2004 |
| JP | 2004-295131 | A | 10/2004 |
| JP | 2004361640 | A | 12/2004 |
| JP | 2005-345722 | | 12/2005 |
| JP | 2006-084899 | A | 3/2006 |
| JP | 2006-215213 | | 8/2006 |
| JP | 4923410 | B2 | 4/2012 |
| JP | 2012-088724 | A | 5/2012 |
| JP | 4930547 | B2 | 5/2012 |
| WO | WO-03/075256 | A1 | 9/2003 |

OTHER PUBLICATIONS

Japanese Office Action issued Feb. 15, 2011 for related Japanese Application No. 52009-125229.

Two Japanese Office Action issued on Jun. 25, 2013 for the corresponding Japanese Application Nos. 2011-264386 & 2011-264387.

* cited by examiner $$I_{ds}=k\mu(V_{gs}-V_{th})^2=k\mu(V_{sig}-\Delta V)^2$$

$$I_{ds}=k\mu\left(\frac{V_{sig}}{1+V_{sig}\frac{k\mu}{C}t}\right)^2$$

PIXEL CIRCUIT, DISPLAY AND DRIVING METHOD THEREOF

CROSS REFERENCE TO RELATED APPLICATIONS

This application is a continuation of U.S. application Ser. No. 13/064,677 filed on Apr. 8, 2011, which is a continuation of U.S. application Ser. No. 11/338,631 filed on Jan. 25, 2006, now U.S. Pat. No. 7,948,456, issued on May 24, 2011, and also claims priority to Japanese Patent Application JP 2005-027028 filed in the Japanese Patent Office on Feb. 2, 2005. The entire contents of these applications are hereby incorporated by reference.

BACKGROUND OF THE INVENTION

The present invention relates to a pixel circuit for current-driving a light-emitting element provided for each pixel. The invention also relates to a display that includes the pixel circuits arranged in a matrix (in rows and columns), and particularly to an active-matrix display that employs insulated-gate field effect transistors provided in the respective pixel circuits and controlling the amount of a current applied to a light-emitting element, such as an organic electro-luminescence (EL) element.

In an image display, e.g., in a liquid crystal display, a number of liquid crystal pixels are arranged in a matrix, and the transmittance intensity or reflection intensity of incident light is controlled on each pixel basis in accordance with information of images to be displayed, to thereby display the images. A similar principle also holds for an organic EL display employing organic EL elements for pixels. The organic EL element however is a self-luminous element unlike the liquid crystal pixel. Therefore, the organic EL display has advantages over the liquid crystal display: high image visibility, no backlight, and high response speed. Furthermore, the organic EL display is a current-control display, which allows control of the luminance (gray-scale) of each light-emitting element by a current applied to the emitting element, and therefore is significantly different from a liquid crystal display, which is a voltage-control display.

Driving systems for the organic EL display include a simple-matrix system and an active-matrix system similarly to the liquid crystal display. The simple-matrix system employs a simple configuration, but involves difficulties of fabricating large-size and high-definition displays. Therefore, the active-matrix displays have been developed more actively in recent years. In the active-matrix system, a current applied to a light-emitting element in each pixel circuit is controlled by an active element (typically a thin film transistor (TFT)) provided in the pixel circuit. Examples of the active-matrix system have been disclosed in Japanese Patent Laid-opens No. 2003-255856, 2003-271095, 2004-133240, 2004-029791, and 2004-093682.

A pixel circuit in related art is disposed at each of intersections between row scan lines that supply control signals and column signal lines that supply video signals. Each pixel circuit includes at least a sampling transistor, a capacitive part, a drive transistor and a light-emitting element. The sampling transistor conducts in response to the control signal supplied from the scan line, to sample the video signal supplied from the signal line. The capacitive part holds an input voltage corresponding to the sampled video signal. The drive transistor supplies an output current during a certain emission period depending on the input voltage held by the capacitive part. Typically the output current has dependence on the carrier mobility in the channel region of the drive transistor and the threshold voltage of the drive transistor. The output current supplied from the drive transistor causes the light-emitting element to emit light with a luminance dependent upon the video signal.

The drive transistor receives at the gate thereof the input voltage held by the capacitive part, and conducts the output current between the source and drain thereof, to thereby apply the current to the light-emitting element. Typically the emission luminance of the light-emitting element is proportional to the applied current amount. In addition, the amount of the output current supplied from the drive transistor is controlled by the gate voltage, i.e., the input voltage written to the capacitive part. The pixel circuit in the past changes the input voltage applied to the gate of the drive transistor depending on the input video signal, to thereby control the amount of a current supplied to the light-emitting element.

The operating characteristic of the drive transistor is expressed by Equation 1.

$$Ids=(1/2)\mu(W/L)Cox(Vgs-Vth)^2 \quad \text{Equation 1}$$

In Equation 1, which is a transistor characteristic equation, Ids denotes a drain current flowing between the source and drain. This current is an output current supplied to the light-emitting element in the pixel circuit. Vgs denotes a gate voltage applied to the gate based on the potential at the source. The gate voltage is the above-described input voltage in the pixel circuit. Vth denotes the threshold voltage of the transistor. μ denotes the mobility in a semiconductor thin film serving as the channel of the transistor. In addition, W, L and Cox denote the channel width, channel length and gate capacitance, respectively. As is apparent from Equation 1, when a thin film transistor operates in its saturation region, the transistor is turned on to conduct the drain current Ids if the gate voltage Vgs is larger than the threshold voltage Vth. In principle, a constant gate voltage Vgs invariably supplies the same drain current Ids to the light-emitting element as shown by Equation 1. Therefore, supplying video signals having the same level to all pixels in a screen should allow all the pixels to emit light with the same luminance, and thus should achieve uniformity of the screen.

In fact, however, thin film transistors (TFT) formed of a semiconductor thin film, such as a poly silicon film, involve variation in the device characteristics. In particular, the threshold voltage Vth is not constant but varies from pixel to pixel. As is apparent from Equation 1, even if the gate voltage Vgs is constant, variation in the threshold voltage Vth among the drive transistors leads to variation in the drain current Ids. Thus, the luminance varies depending on each pixel, which spoils uniformity of the screen. In related art, there has been developed a pixel circuit that has a function of canceling variation in the threshold voltage among drive transistors. For example, this pixel circuit is disclosed in the above-mentioned Japanese Patent Laid-open No. 2004-133240.

The pixel circuit provided with the function of canceling variation in the threshold voltage can improve uniformity of a screen to some extent. However, of the characteristics of poly-silicon TFTs, not only the threshold voltage but also the mobility μ vary depending on each element. As Equation 1 shows, variation in the mobility μ results in variation in the drain current Ids even if the gate voltage Vgs is constant. As a result, emission luminance varies from pixel to pixel, which problematically spoils uniformity of a screen.

SUMMARY OF THE INVENTION

In consideration of the above-described problems of the related art, an object of the present invention is to provide a pixel circuit, a display, and a driving method thereof that each allow canceling of the influence of the mobility, to thereby permit compensation of variation in drain currents (output currents) supplied from drive transistors.

According to one embodiment of the present invention, there is provided a pixel circuit disposed at an intersection of a scanning line and a signal line. The pixel circuit comprises a sampling transistor that samples a video signal from the signal line, a capacitive part that holds an input voltage that includes the sampled video signal, a drive transistor that receives the input voltage held by the capacitive part and supplies an output current, and a light-emitting element that receives the output current supplied by the drive transistor and emits light with a luminance dependent upon the video signal. A correction unit corrects the input voltage held by the capacitive part before an emission period to cancel dependence of the output current on a carrier mobility of the drive transistor.

According to another embodiment of the present invention, there is provided a display that includes a pixel array part having scan lines disposed on rows, signal lines disposed on columns, and a matrix of pixels disposed at intersections between the scan and signal lines, a signal part supplying a video signal to the signal lines, and a scanner part supplying a control signal to the scan lines to sequentially scan the pixels on each row basis. At least one individual pixel (e.g., one or more in the matrix) comprises a sampling transistor that samples a video signal from the signal line, a capacitive part that holds an input voltage that includes the sampled video signal, a drive transistor that receives the input voltage held by the capacitive part and supplies an output current, and a light-emitting element that receives the output current supplied by the drive transistor and emits light with a luminance dependent upon the video signal. A correction unit corrects the input voltage held by the capacitive part before an emission period to cancel dependence of the output current on a carrier mobility of the drive transistor.

According to another embodiment of the present invention, there is provided a method of driving a display that includes a pixel array part, a scanner part and a signal part, the pixel array part including scan lines, signal lines, and a matrix of pixels disposed at intersections between the scan and signal lines, the signal part supplying a video signal to the signal lines, the scanner part supplying a control signal to the scan lines to sequentially scan the pixels, individual ones of the pixels including at least a sampling transistor, a capacitive part, a drive transistor, and a light-emitting element. The method comprises sampling the video signal from the signal line; holding an input voltage that includes the sampled video signal in the capacitive part; supplying the input voltage held by the capacitive part to the drive transistor and supplying from the drive transistor an output current to the light-emitting element, which emits light with a luminance dependent upon the video signal; and correcting the input voltage held by the capacitive part before an emission period to cancel dependence of the output current on a carrier mobility of the drive transistor.

According to another embodiment, correction of the input voltage held by the capacitive part is during a beginning portion of an emission period to cancel dependence of the output current on a carrier mobility of the drive transistor.

According to still another embodiment, correction of the input voltage held by the capacitive part is during a period in which the sampling transistor is on to cancel dependence of the output current on a carrier mobility of the drive transistor.

According to certain embodiments of the present invention, a pixel circuit includes a correction unit that corrects an input voltage (gate voltage) for a drive transistor to cancel the dependence of the output current from the drive transistor on the carrier mobility. This may, for example, be accommodated by negatively feeding back the output current to the capacitive part to correct the input voltage (gate voltage). As is apparent from Equation 1, the output current (drain current) is proportional to the mobility. Therefore, when a drive transistor in a certain pixel has a high mobility, the output current from the drive transistor is correspondingly large. This output current is negatively fed back to the capacitive part to thereby correct the input voltage (gate voltage). A larger mobility results in a larger negative feedback amount, and therefore the input voltage (gate voltage) is greatly decreased correspondingly. This decrease of the gate voltage results in suppression of the drain current. In contrast, when a drive transistor in another pixel is relatively small, the drain current from the drive transistor is also small. Therefore, the amount of negative feedback to a capacitive part is also small, which leads to a small decrease of the gate voltage. That is, a smaller mobility of a drive transistor provides a smaller output current, which results in a smaller amount of correction.

In addition, mobility correction may be carried out while a signal potential is sampled. The amplitude of a video signal potential changes corresponding to a gray-scale level range from a black level to a white level. At any level, the mobility correction can be implemented adequately. The amount of negative feedback to an input voltage depends on a time period for extracting an output current. A longer extraction time period offers a larger negative feedback amount. The time period for extracting an output current may be varied within a sampling period to optimize the negative feedback amount.

Furthermore, light-emitting elements are current-driven due to sampling of video signal potentials. A voltage signal driver, which has been widely used in active-matrix liquid crystal displays in the past, may be used for a signal part in some embodiments of the invention. In addition, similar to active-matrix liquid crystal panels in the past on which polysilicon transistors are integrally formed, a display of one embodiment of the invention can also be fabricated as a peripheral-circuit-incorporated panel, in which peripheral scanner part and signal part are integrated with a pixel array part.

DETAILED DESCRIPTION OF THE PREFERRED EMBODIMENTS

Figure 1:
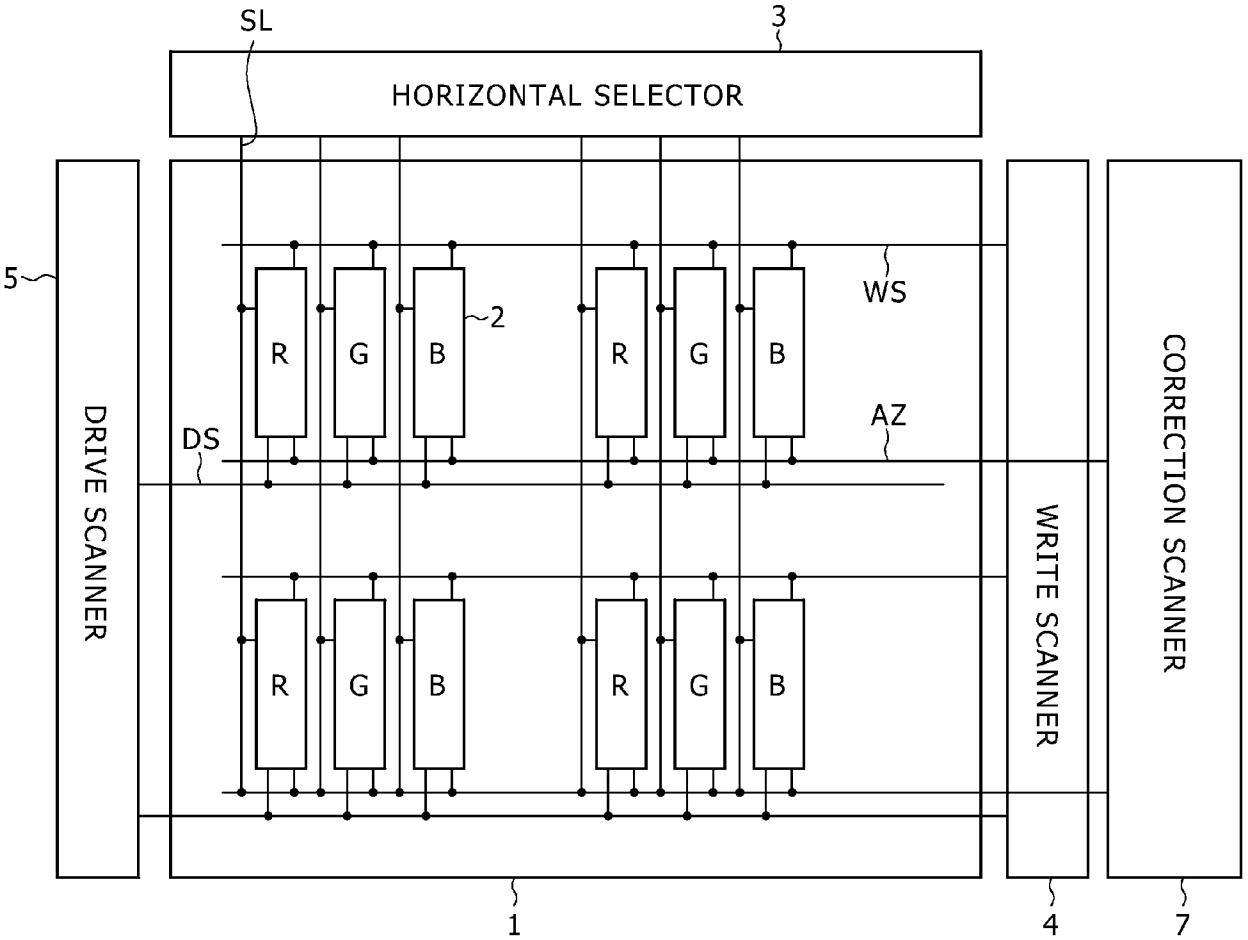
FIG. 1 is a block diagram illustrating a reference example of a display.

Embodiments of the present invention will be described below in detail with reference to the accompanying drawings. Initially, in order to clearly show the background of the invention, a reference example of an active-matrix display having a function of correcting the threshold voltage Vth will be described with reference to FIG. 1. Referring to FIG. 1, the active-matrix display includes a pixel array 1 that is a major part, and a peripheral circuit part. The peripheral circuit part includes a horizontal selector 3, a write scanner 4, a drive scanner 5, a correction scanner 7, and so on. The pixel array 1 includes pixels R, G and B that are disposed at the intersections between row scan lines WS and column signal lines SL, and thus are arranged in a matrix. Although pixels of three primary colors of RGB are used to allow color displaying in the example, the present invention is not limited thereto. Each of the pixels R, G and B is formed of a pixel circuit 2. The signal lines SL are driven by the horizontal selector 3. The horizontal selector 3 serves as a signal part, and supplies video signals to the signal lines SL. The scan lines WS are scanned by the write scanner 4. Other scan lines DS and AZ are also wired parallel to the scan lines WS. The scan lines DS are scanned by the drive scanner 5. The scan lines AZ are scanned by the correction scanner 7. The write scanner 4, the drive scanner 5 and the correction scanner 7 serve as a scanner part, and sequentially scan a respective one of the rows in each one horizontal period. Each pixel circuit 2 samples the video signal from the signal line SL when being selected by the scan line WS. Furthermore, when being selected by the scan line DS, the pixel circuit 2 drives a light-emitting element included therein according to the sampled video signal. In addition, the pixel circuit 2 implements predetermined correction operation when being scanned by the scan line AZ.

The pixel array 1 is typically formed on an insulating substrate, such as a glass substrate, to be formed on a flat panel. Each pixel circuit 2 is formed of amorphous silicon TFTs or low-temperature poly-silicon TFTs. When the pixel circuit 2 is formed of amorphous silicon TFTs, the scanner part is formed on a panel other than the flat panel including the pixel array 1 based on TAB or the like, followed by being coupled to the flat panel via a flexible cable. When the pixel circuit 2 is formed of the low-temperature poly-silicon TFTs, since the signal part and scanner part are also formed of the low-temperature poly-silicon TFTs, the pixel array 1, the signal part and the scanner part can integrally be formed on the same flat panel.

Figure 2:
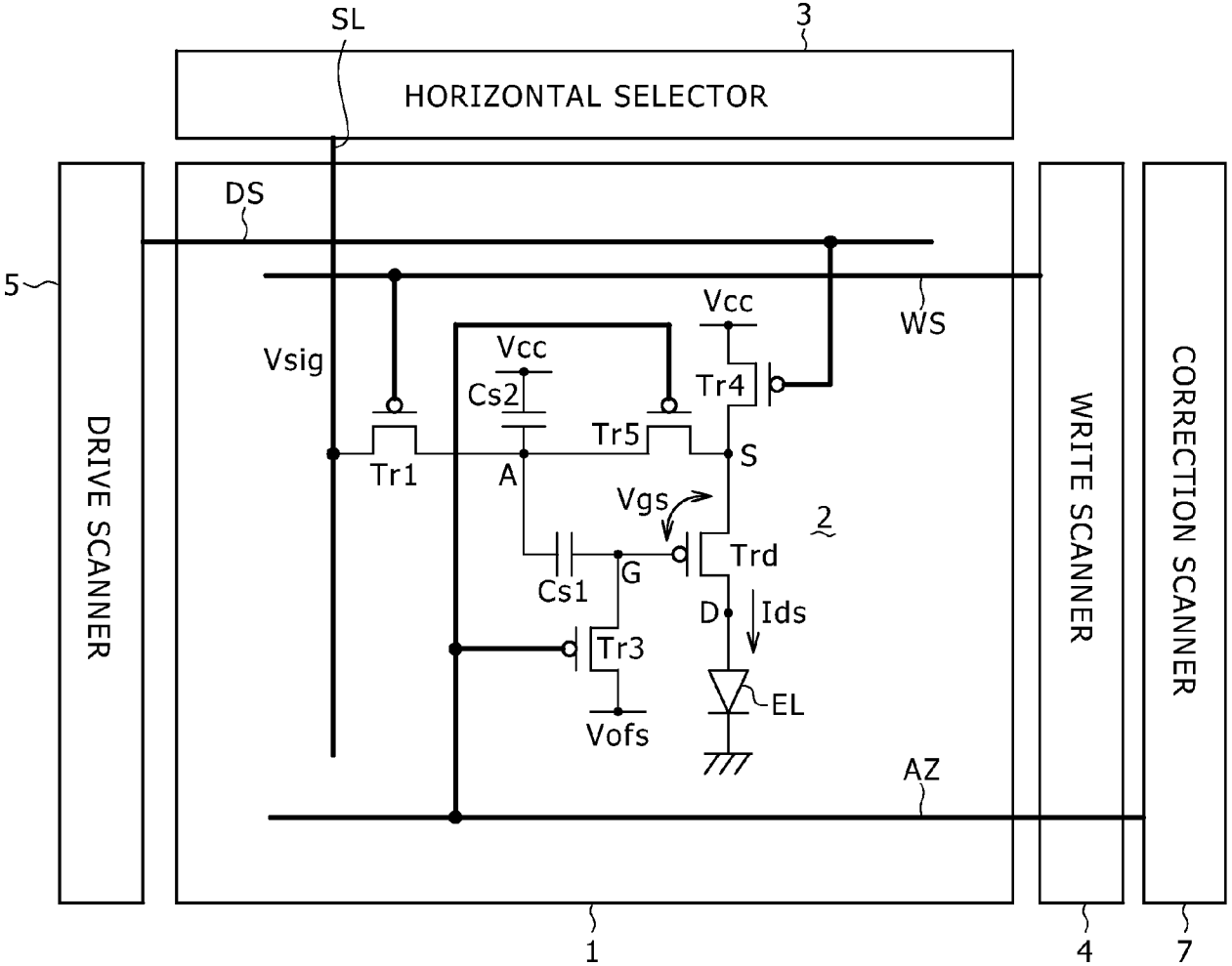
FIG. 2 is a circuit diagram illustrating the configuration of a pixel circuit included in the display of FIG. 1.

FIG. 2 is a circuit diagram illustrating the configuration of the pixel circuit included in the pixel array shown in FIG. 1. Referring to FIG. 2, the pixel circuit 2 includes five thin film transistors Tr1-Tr4 and Trd, two capacitive elements Cs1 and Cs2, and one light-emitting element EL. All of the transistors Tr1 to Tr4 and Trd are a P-channel poly-silicon TFT. However, the present invention is not limited thereto. The transistors may include N-channel poly-silicon TFTs. Alternatively, the pixel circuit may include N-channel amorphous silicon TFTs. Two capacitive elements Cs1 and Cs2 integrally form the capacitive part of the pixel circuit 2. The light-emitting element EL is e.g. a diode organic EL element having an anode and a cathode. However, the present invention is not limited thereto. The light-emitting element encompasses all typical devices that are current-driven to emit light.

The gate (G) of the drive transistor Trd, which is central to the pixel circuit 2, is coupled to a point G. The source (S) and drain (D) thereof are coupled to points S and D, respectively. The anode of the light-emitting element EL is coupled to the point D, while the cathode thereof is grounded. The switching transistor Tr4 is coupled between a supply potential Vcc and the point S, and controls switching on and off of the light-emitting element EL. The gate of the transistor Tr4 is coupled to the scan line DS.

The sampling transistor Tr1 is coupled between the signal line SL and a point A. The gate of the sampling transistor Tr1 is coupled to the scan line WS. The detection transistor Tr5 is coupled between the points A and S. The gate thereof is coupled to the scan line AZ. The switching transistor Tr3 is coupled between the point G and a certain offset potential Vofs. The gate thereof is coupled to the scan line AZ. The detection transistor Tr5 and the switching transistor Tr3 form a correction unit for canceling the threshold voltage Vth. One capacitive element Cs1 is coupled between the points A and G, while the other capacitive element Cs2 is coupled between the supply potential Vcc and the point A.

The drive transistor Trd conducts the drain current Ids between the source and drain according to the gate voltage Vgs applied between the source and gate, to thereby drive the light-emitting element EL with the drain current Ids. In the present specification, the gate voltage Vgs and the drain current Ids are defined as the input voltage and output current, respectively. The gate voltage Vgs is set depending on the video signal Vsig supplied from the signal line SL, and the drain current Ids is applied based on the gate voltage Vgs. Thus, the emission luminance of the light-emitting element EL can be controlled in accordance with the gray-scale of the video signal.

The threshold voltage Vth of the drive transistor Trd varies depending on each pixel. In order to cancel this variation, the threshold voltage Vth of the drive transistor Trd is detected and held in the capacitive element Cs1 in advance. Subsequently, the sampling transistor Tr1 is turned on to write the signal potential Vsig to the capacitive element Cs2. The drive transistor Trd is driven by the thus set gate voltage Vgs.

Figure 3:
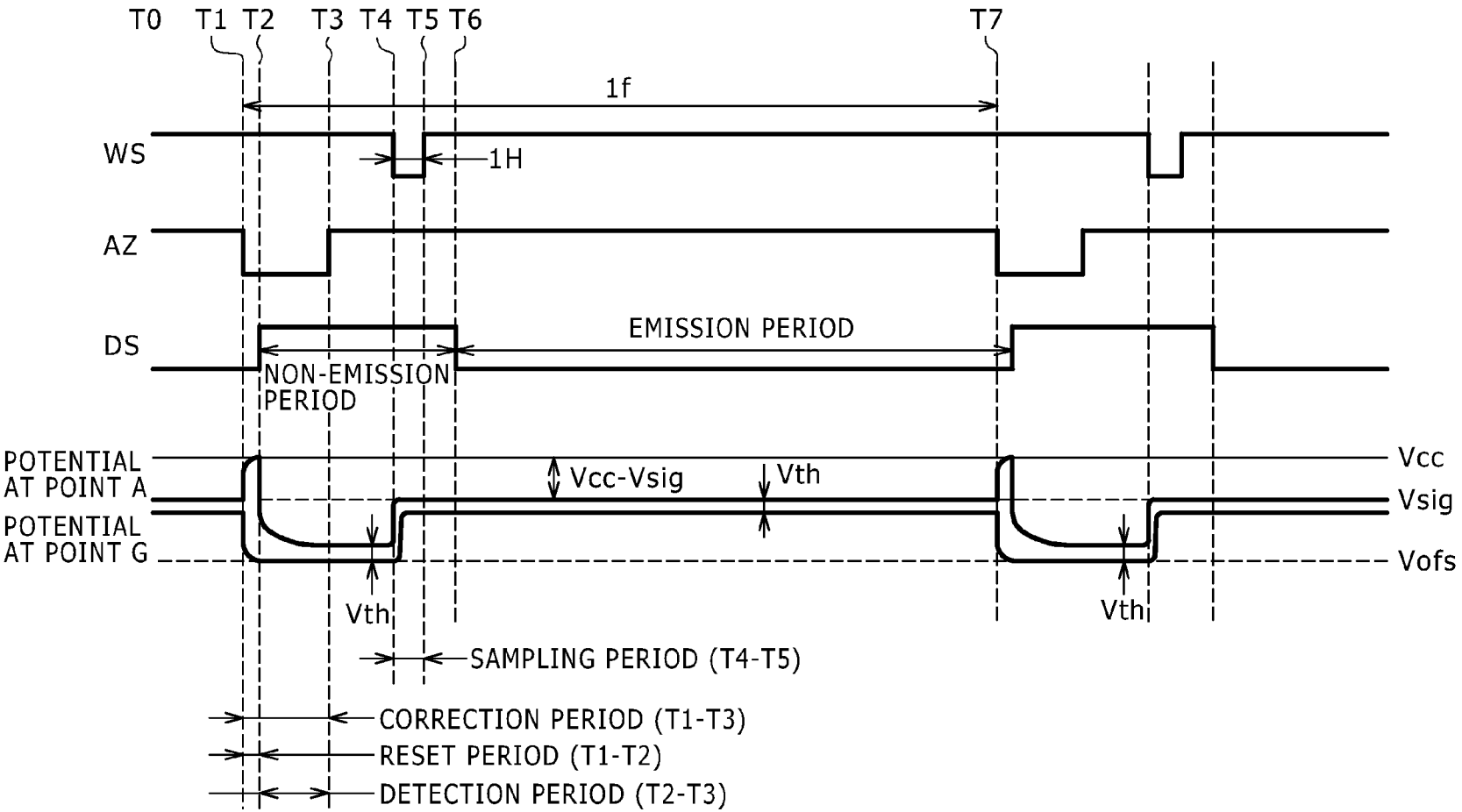
FIG. 3 is a reference timing chart for explaining the operation of the pixel circuit in FIG. 2.

FIG. 3 is a timing chart for explaining the operation of the pixel circuit of FIG. 2. FIG. 3 illustrates along a time axis T the waveforms of control signals applied to the scan lines WS, AZ and DS. For simplified description, each control signal is given the same numeral as that of the corresponding scan line hereinafter. Since all the transistors are a P-channel transistor, the transistor is in the off-state when the corresponding scan line is at the high level, and is in the on-state when it is at the low level. Therefore, for simplified description, fall down of the control signal from the high level to the low level will be referred to also as "on", while rise up from the low level to the high level will be referred to also as "off", in the present reference example. FIG. 3 also illustrates potential changes at the points A and G as well as the waveforms of the control signals WS, AZ and DS. When the transistors are an N-channel transistor, inversely, fall down of the control signal from the high level to the low level will be referred to also as "off", while rise up from the low level to the high level will be referred to also as "on".

In the timing chart, the period from timing T1 to T7 is defined as one field (1f). During one field, each row of the pixel array is sequentially scanned once. The timing chart illustrates the waveforms of the control signals WS, AZ and DS applied to the pixels on one row.

At timing T0, which is prior to the start of one field, the control signals WS and AZ are "off", while the control pulse DS is "on". Therefore, the sampling transistor Tr1, the detection transistor Tr5 and the switching transistor Tr3 are in the off-state while only the switching transistor Tr4 is in the on-state. In this state, the point A is at the signal potential Vsig, and the point G is at the potential lower than Vsig by Vth. At this time, the point S is at Vcc since the transistor Tr4 is in the on-state. Therefore, a sufficient voltage larger than Vth is applied between the source and gate of the transistor Trd, which supplies the output current Ids to the light-emitting element EL. Thus, the light-emitting element EL is in the emission state at the timing T0.

Subsequently, at the timing T1, which is the start of the field, the control signal AZ is switched "on" and thus the transistors Tr5 and Tr3 are turned on. This operation directly couples the point A with the point S, and therefore the potential at the point A sharply rises up to the supply potential Vcc. In addition, since the transistor Tr3 is turned on, the potential at the point G sharply falls down to the certain offset potential Vofs.

At timing T2 immediately after the timing T1, the control signal DS is turned "off" and thus the switching transistor Tr4 enters the non-conductive state. This operation isolates the point S from the supply potential Vcc, which causes the light-emitting element EL to enter the non-emission state. Within the period T1-T2 from the timing T1 to T2, the potential at the point A becomes Vcc while the potential at the point G becomes Vofs. Therefore, the potentials of the capacitive elements Cs1 and Cs2 are reset. This reset operation serves as a preparation for stabilizing the subsequent detection operation. The period T1-T2 is referred to as a reset period.

Since the switch "off" of the control signal DS at the timing T2 isolates the point S from Vcc, the power feed from the power supply is interrupted, while discharging of the capacitive element Cs1 is initiated and thus a transient current flows via the transistor Tr5, which lowers the potential at the point A from Vcc. The transient current disappears when the potential at the point A drops to the potential larger by Vth than the potential at the point G. As a result, the potential difference between the points A and G becomes Vth, and the potential Vth is held in the capacitive element Cs1.

At timing T3, the control signal AZ is turned "off". Therefore, the transistors Tr5 and Tr3 are turned off, which isolates the capacitive element Cs1 from Vofs and the point S. Since Vth is detected and held in Cs1 during the period from the timing T2 to T3, the period T2-T3 is referred to as a detection period. The detection period T2-T3 is designed to have a sufficient long time width so that the transient current flowing to the drive transistor falls off to zero.

As described above, the reset operation during the reset period T1-T2 and the detection operation during the detection period T2-T3 serve as the correction operation for the threshold voltage Vth. Therefore, the period T1-T3, which is the sum of the reset and detection periods, is referred to as a Vth correction period. In some cases, the period T2-T3 is referred to as the Vth correction period. As is apparent from the timing chart of FIG. 3, the Vth correction period T1-T3 is defined by the control signal AZ. In addition, the control signal DS separates the reset period T1-T2 from the detection period T2-T3 in the Vth correction period T1-T3. The control signal DS basically controls switch on and off of the switching transistor Tr4, and therefore defines the non-emission period and emission period.

At timing T4 after the correction period T1-T3, the control signal WS is switched "on", which turns on the sampling transistor Tr1. As a result, the video signal Vsig supplied from the signal line SL is sampled and held in the capacitive element Cs2. Thus, the potential at the point A rises from Vofs+Vth to the signal potential Vsig. In conjunction with the potential rise, the potential at the point G also rises while maintaining the potential difference Vth from the potential at the point A. As the timing chart shows, the potential difference between the points A and G is kept at Vth even after the sampling is completed. Subsequently, at timing T5 after the elapse of one horizontal period, the control signal WS is switched "off" and thus the sampling transistor Tr1 enters the non-conductive state. Since the sampling operation for sampling Vsig and holding it in Cs2 is implemented during the period T4-T5, this period is referred to as a sampling period. The length of the sampling period T4-T5 is equal to that of one horizontal period 1H.

At timing T6, the control signal DS is turned "on" again, which turns on the switching transistor Tr4. This switching causes the drive transistor Trd to supply the drain current Ids to the light-emitting element EL according to the potential difference Vgs between the potentials at the points S and G. Thus, the light-emitting element EL emits light with a luminance dependent upon Vgs.

At timing T7, the field ends and simultaneously the next field starts. Initially the reset period starts in the next field.

Based on the timing chart of FIG. 3, the input voltage Vgs during the sampling period T4-T5 and the subsequent emission period will be obtained below. The input voltage Vgs is the potential at the point G relative to the potential at the point S. In the emission period after the sampling period T4-T5, the point S is coupled to the power supply and therefore the potential thereat is Vcc since the transistor Tr4 is in the on-state. The potential at the point A is lower by Vsig than Vcc as described above. In addition, the potential at the point G is lower by Vth than the potential at the point A. Therefore, Vgs, which is the potential at the point G relative to the potential at the point S, is expressed as Vcc−(Vsig−Vth). When the obtained Vcc−(Vsig−Vth) is substituted for Vgs of Equation 1, the following equation is obtained.

$$Ids=(1/2)\mu(W/L)Cox(Vcc-Vsig)^2$$

In this characteristic equation, the term (Vcc-Vsig) exists instead of the term (Vgs-Vth) included in Equation 1, and thus Vth is cancelled. Therefore, the pixel circuit 2 of FIG. 2 can supply to the light-emitting element EL, the output current Ids according to the value of Vsig independently of Vth of the drive transistor Trd. Accordingly, even if Vth of the drive transistor Trd varies from pixel to pixel, the pixel array can supply to the light-emitting element EL of each pixel, an output current from which the variation has been eliminated.

Figure 4:
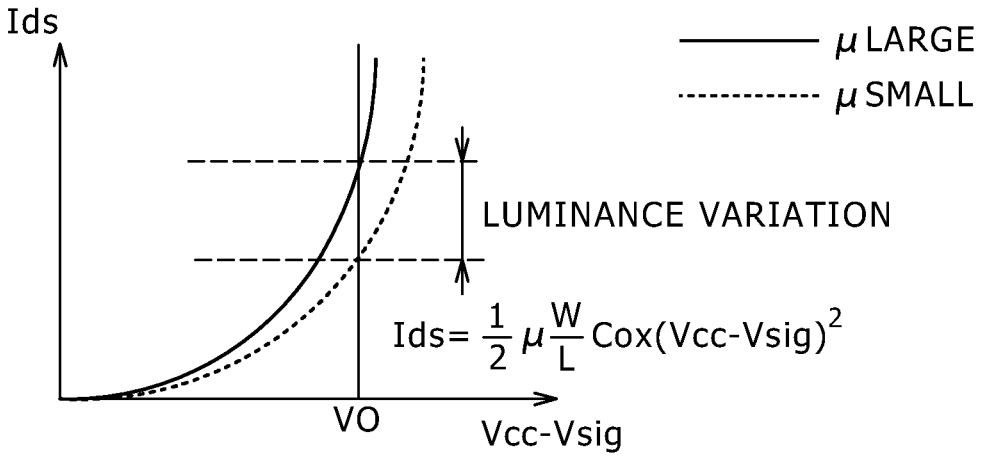
FIG. 4 is a graph illustrating the output current characteristic of a drive transistor.

FIG. 4 illustrates a graph of the characteristic equation. The output current Ids is plotted on the ordinate and the voltage Vcc-Vsig on the abscissa. The characteristic equation is represented beside the graph. As the characteristic equation shows, the term Vth of the drive transistor is absent. However, the mobility μ remains in the equation. The mobility μ depends on the device as with Vth, and varies from pixel to pixel. Therefore, canceling only Vth does not lead to complete elimination of variation in the output current Ids. In the graph, the transistor characteristic corresponding to a large μ is expressed with the solid line while that corresponding to a small μ is expressed with the dashed line. As is apparent from the graph, a larger coefficient μ in the characteristic equation leads to a steeper characteristic curve. Therefore, even when Vcc-Vsig is constant (=V0), the output current Ids varies depending on μ since there is variation in the mobility μ among pixels, which results in variation in the luminance among the pixels. In particular when Vcc−Vsig has a value for displaying a gray-scale in a range from gray to white, the luminance variation depending on the mobility μ is significantly large and displaying unevenness arises. This unevenness is a serious problem that should be solved.

Figure 5:
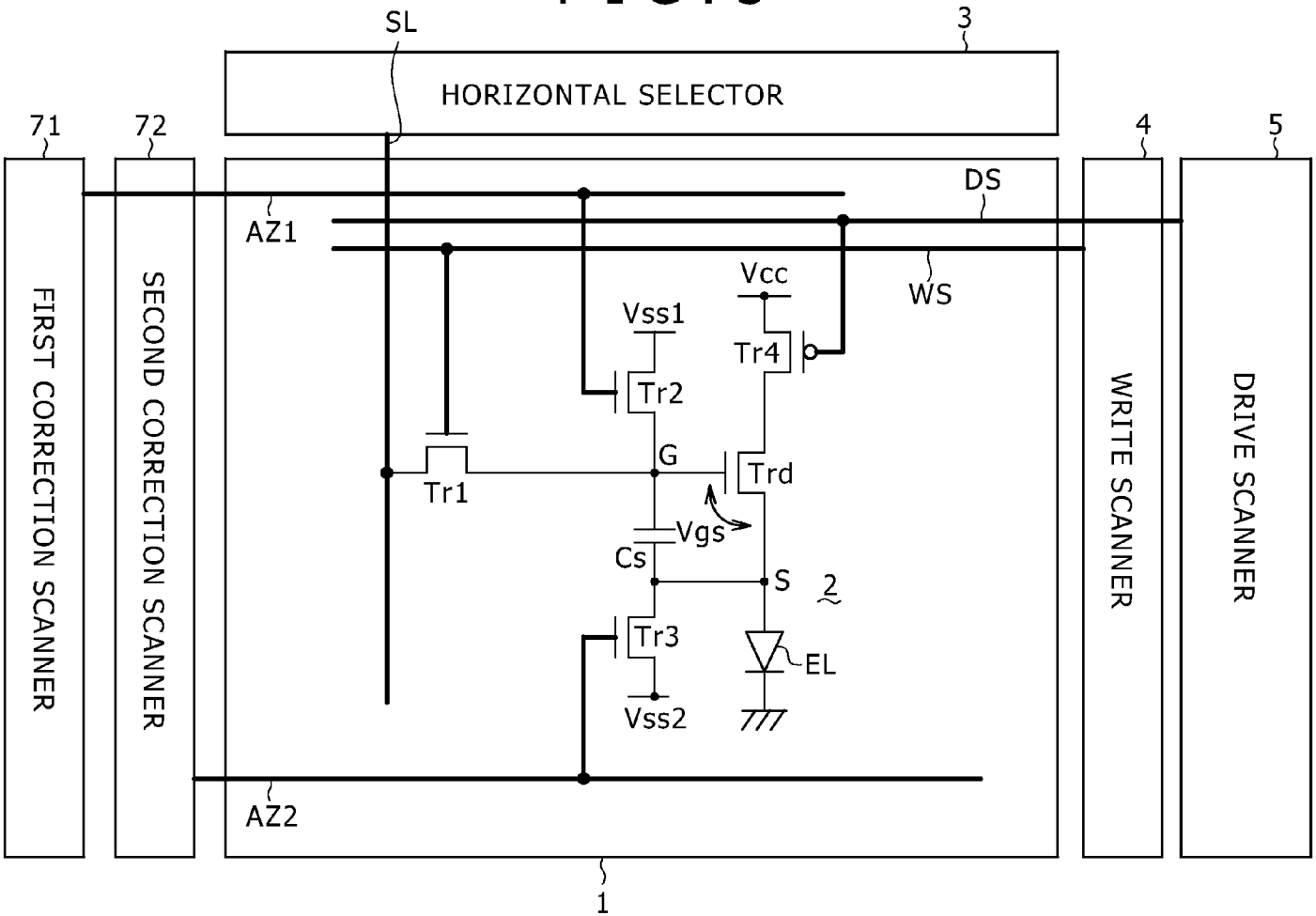
FIG. 5 is a block diagram illustrating a display according to a first embodiment of the present invention.

FIG. 5 is a circuit diagram illustrating a display according to a first embodiment of the present invention. Referring to FIG. 5, an active-matrix display includes the pixel array 1 that is a major part, and a peripheral circuit part. The peripheral circuit part includes the horizontal selector 3, the write scanner 4, the drive scanner 5, a first correction scanner 71, a second correction scanner 72, and so on. The pixel array 1 includes the pixel circuits 2 that are disposed at the intersections between the row scan lines WS and the column signal lines SL, and thus are arranged in a matrix. For easy understanding, FIG. 5 illustrates only one pixel circuit 2 in a magnified form. The signal lines SL are driven by the horizontal selector 3. The horizontal selector 3 serves as a signal part, and supplies video signals to the signal lines SL. The scan lines WS are scanned by the write scanner 4. Other scan lines DS, AZ1 and AZ2 are also wired parallel to the scan lines WS. The scan lines DS are scanned by the drive scanner 5. The scan lines AZ1 are scanned by the first correction scanner 71. The scan lines AZ2 are scanned by the second correction scanner 72. The write scanner 4, the drive scanner 5, the first correction scanner 71, and the second correction scanner 72 serve as a scanner part, and sequentially scan a respective one of the rows in each one horizontal period. Each pixel circuit 2 samples the video signal from the signal line SL when being selected by the scan line WS. Furthermore, when being selected by the scan line DS, the pixel circuit 2 drives the light-emitting element EL included therein according to the sampled video signal. In addition, the pixel circuit 2 implements predetermined correction operation when being selected by the scan lines AZ1 and AZ2.

The pixel circuit 2 includes five TFTs Tr1-Tr4 and Trd, one capacitive element (pixel capacitor) Cs, and one light-emitting element EL. The transistors Tr1 to Tr3 and Trd are an N-channel poly-silicon TFT. Only the transistor Tr4 is a P-channel poly-silicon TFT. The capacitive element Cs serves as a capacitive part in this pixel circuit 2. The light-emitting element EL is e.g. a diode organic EL element having an anode and a cathode. However, the present invention is not limited thereto. The light-emitting element encompasses all typical devices that are current-driven to emit light.

The gate G of the drive transistor Trd, which is central to the pixel circuit 2, is coupled to one end of the pixel capacitor Cs, and the source S thereof is coupled to the other end of the pixel capacitor Cs. The gate G of the drive transistor Trd is also coupled via the switching transistor Tr2 to another reference potential Vss1. The drain of the drive transistor Trd is coupled via the switching transistor Tr4 to the power supply Vcc. The gate of the switching transistor Tr2 is coupled to the scan line AZ1. The gate of the switching transistor Tr4 is coupled to the scan line DS. The anode of the light-emitting element EL is coupled to the source S of the drive transistor Trd while the cathode thereof is grounded. This ground potential is sometimes expressed by Vcath. The switching transistor Tr3 is interposed between the source S of the drive transistor Trd and a certain reference potential Vss2. The gate of the transistor Tr3 is coupled to the scan line AZ2. The sampling transistor Tr1 is coupled between the signal line SL and the gate G of the drive transistor Trd. The gate of the sampling transistor Tr1 is coupled to the scan line WS.

In this pixel circuit 2, the sampling transistor Tr1 conducts in response to the control signal WS supplied from the scan line WS during a certain sampling period, to sample the video signal Vsig supplied from the signal line SL in the capacitive part Cs. The capacitive part Cs applies the input voltage Vgs between the gate G and the source S of the drive transistor according to the sampled video signal Vsig. The drive transistor Trd supplies to the light-emitting element EL, the output current Ids dependent upon the input voltage Vgs during a certain emission period. The output current (drain current) Ids has dependence on the carrier mobility μ in the channel region of the drive transistor Trd and the threshold voltage Vth of the drive transistor Trd. The output current Ids supplied from the drive transistor Trd causes the light-emitting element EL to emit light with a luminance dependent upon the video signal Vsig.

The present embodiment has a characteristic that the pixel circuit 2 includes a correction unit formed of the switching transistors Tr2 to Tr4, and corrects in advance the input voltage Vgs held in the capacitive part Cs at the beginning of an emission period, in order to cancel the dependence of the output current Ids on the carrier mobility p. Specifically, the correction unit (Tr2 to Tr4) operates during part of a sampling period in response to the control signal DS supplied from the scan line DS. Thus, the correction unit extracts the output current Ids from the drive transistor Trd while the video signal Vsig is sampled, and negatively feeds back the output current Ids to the capacitive part Cs to thereby correct the input voltage Vgs. In addition, in order to also cancel the dependence of the output current Ids on the threshold voltage Vth, this correction unit (Tr2 to Tr4) detects in advance the threshold voltage Vth of the drive transistor Trd and adds the detected threshold voltage Vth to the input voltage Vgs, prior to the sampling period.

In the present embodiment, the drive transistor Trd is an N-channel transistor, and the drain thereof is coupled to the power supply Vcc while the source S thereof is coupled to the light-emitting element EL. In this configuration, the above-described correction unit extracts the output current Ids from the drive transistor Trd and negatively feeds it back to the capacitive part Cs, during beginning part of an emission period. This beginning part overlaps with later part of a sampling period. At the time of the feedback, the correction unit causes the output current Ids extracted from the source S of the drive transistor Trd during the beginning part of the emission period to flow to a capacitor inhering in the light-emitting element EL. Specifically, the light-emitting element EL is a diode light-emitting element having an anode and a cathode, and the anode thereof is coupled to the source S of the drive transistor Trd while the cathode thereof is grounded. Based on this configuration, the correction unit (Tr2 to Tr4) sets the anode and cathode of the light-emitting element EL to be in a reverse biased state in advance, and causes the diode light-emitting element EL to serve as a capacitive element when the output current Ids extracted from the source S of the drive transistor Trd flows to the light-emitting element EL. The correction unit can adjust the time width t of a period during which the output current Ids is extracted from the drive transistor Trd within a sampling period, and thereby can optimize the amount of negative feedback of the output current Ids to the capacitive part Cs.

Figure 6:
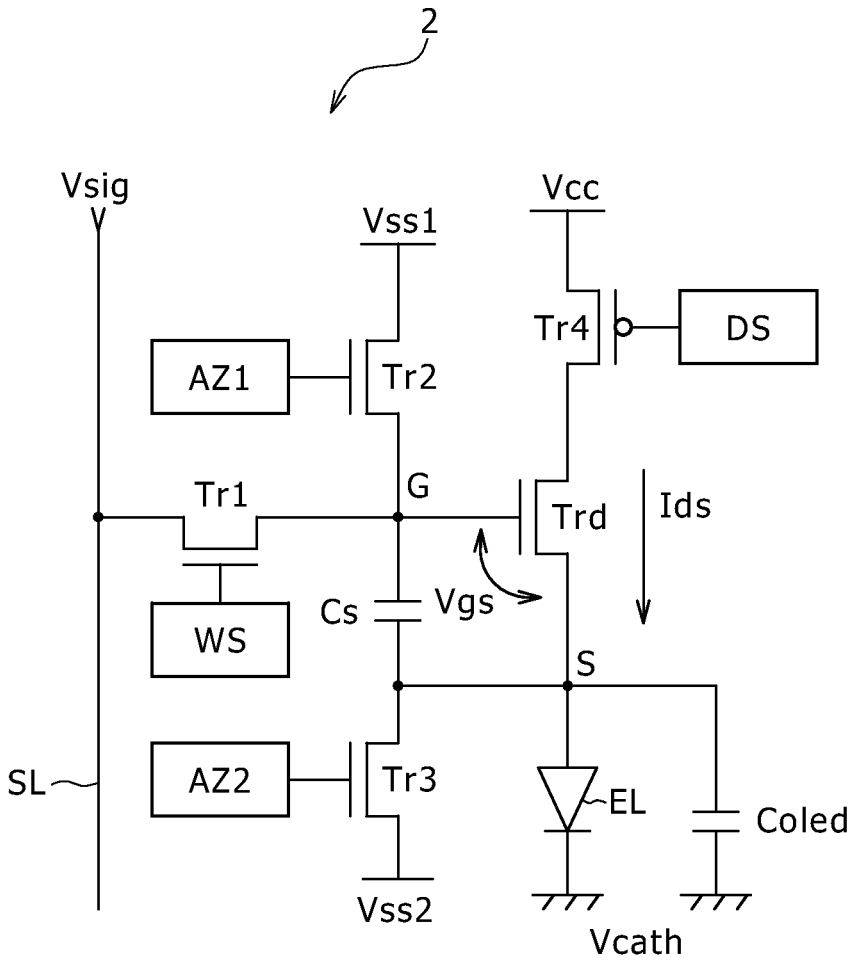
FIG. 6 is a schematic diagram focusing on the pixel circuit included in the display in FIG. 5.

FIG. 6 is a schematic diagram focusing on pixel circuit part in the display shown in FIG. 5. In order to facilitate understanding, FIG. 6 also indicates the video signal Vsig, which is sampled by the sampling transistor Tr1, the input voltage Vgs and the output current Ids of the drive transistor Trd, and a capacitive component Coled included in the light-emitting element EL. The basic operation of the pixel circuit 2 will be described below based on FIG. 6.

Figure 7:
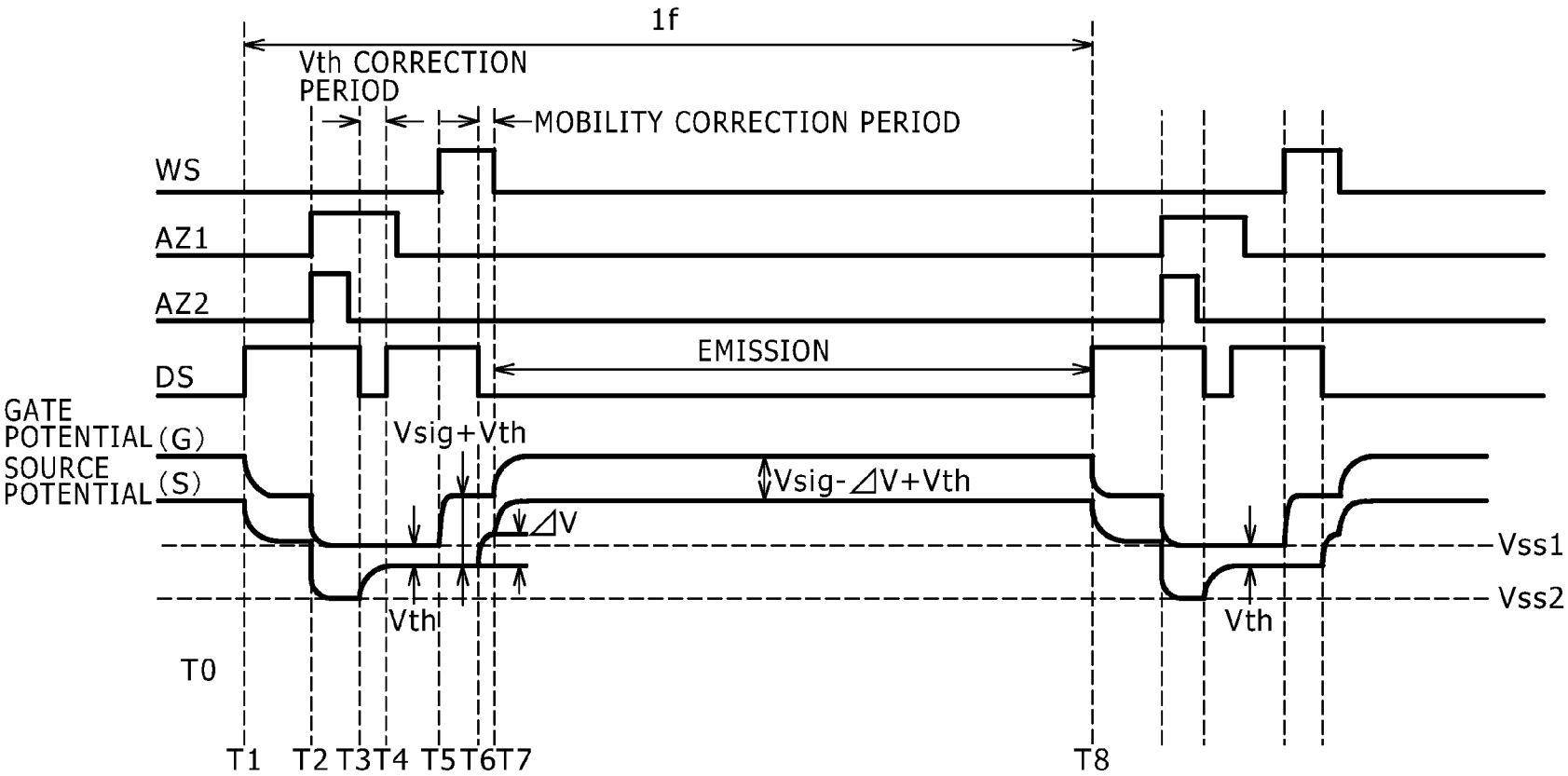
FIG. 7 is a timing chart for explaining the operation of the pixel circuit in FIG. 6.

FIG. 7 is a timing chart regarding the pixel circuit in FIG. 6. The operation of the pixel circuit of FIG. 6 will be described specifically in detail with reference to FIG. 7. FIG. 7 illustrates along a time axis T the waveforms of control signals applied to the scan lines WS, AZ1, AZ2, and DS. For simplified description, each control signal is given the same numeral as that of the corresponding scan line. Since the transistors Tr1, Tr2 and Tr3 are an N-channel transistor, they are in the on-state when the scan lines WS, AZ1 and AZ2 are at the high level while they are in the off-state when these scan lines are at the low level. In contrast, the transistor Tr4 is a P-channel transistor, and therefore is in the off-state when the scan line DS is at the high level, and is in the on-state when it is at the low level. This timing chart also illustrates potential changes at the gate G and the source S of the drive transistor Trd as well as the waveforms of the control signals WS, AZ1, AZ2 and DS.

In the timing chart of FIG. 7, the period from timing T1 to T8 is defined as one field (1f). During one field, each row of the pixel array is sequentially scanned once. The timing chart illustrates the waveforms of the control signals WS, AZ1, AZ2 and DS applied to the pixels on one row.

At timing T0, which is prior to the start of a certain field, all the control signals WS, AZ1, AZ2 and DS are at the low level. Therefore, the N-channel transistors Tr1, Tr2 and Tr3 are in the off-state while only the P-channel transistor Tr4 is in the on-state. Thus, the drive transistor Trd is coupled to the power supply Vcc via the transistor Tr4 in the on-state, and therefore supplies the output current Ids to the light-emitting element EL according to the certain input voltage Vgs. Accordingly, the light-emitting element EL emits light at the timing T0. The input voltage Vgs applied at this time to the drive transistor Trd is expressed as the potential difference between the gate potential (G) and the source potential (S).

At timing T1, which is the start of the field, the control signal DS is switched from the low level to the high level. Thus, the transistor Tr4 is turned off, which isolates the drive transistor Trd from the power supply Vcc and therefore stops light emission. Accordingly, a non-emission period starts. That is, at the timing T1, all the transistors Tr1 to Tr4 are in the off-state.

Subsequently, at timing T2, the control signals AZ1 and AZ2 are turned to the high level, which turns on the switching transistors Tr2 and Tr3. As a result, the gate G of the drive transistor Trd is coupled to the reference potential Vss1, and the source S thereof is coupled to the reference potential Vss2. The potentials Vss1 and Vss2 satisfy the relationship Vss1−Vss2>Vth. Therefore, the relationship Vss1−Vss2=Vgs>Vth is ensured, which leads to a preparation for Vth correction to be carried out at timing T3. That is, the period T2-T3 is equivalent to the reset period for the drive transistor Trd. Furthermore, the relationship VthEL>Vss2 is ensured, in which VthEL denotes the threshold voltage of the light-emitting element EL. Thus, the light-emitting element EL is supplied with a negative bias, and therefore is in the so-called reverse biased state. This reverse biased state is necessary for normally carrying out Vth correction operation and mobility correction operation later.

At the timing T3, the control signal AZ2 is turned to the low level, and thereupon the control signal DS is also turned to the low level. Thus, the transistor Tr3 is switched off while the transistor Tr4 is switched on. As a result, the drain current Ids flows to the pixel capacitor Cs to thereby initialize the Vth correction operation. At this time, the potential at the gate G of the drive transistor Trd is kept at Vss1. The current Ids flows until the drive transistor Trd is cut off. When the drive transistor Trd is cut off, the source potential (S) of the drive transistor Trd is Vss1−Vth. At timing T4, after the cut-off of the drain current, the control signal DS is returned to the high level again to thereby turn off the switching transistor Tr4. In addition, the control signal AZ1 is returned to the low level to thereby turn off the switching transistor Tr2. As a result, Vth is held and fixed in the pixel capacitor Cs. As described above, during the period T3-T4, the threshold voltage Vth of the drive transistor Trd is detected. The detection period T3-T4 is referred to as a Vth correction period.

After Vth correction is implemented in this manner, the control signal WS is switched to the high level at timing T5. Thus, the sampling transistor Tr1 is turned on to thereby write the video signal Vsig to the pixel capacitor Cs. The pixel capacitance Cs is sufficiently small compared with the equivalent capacitance Coled of the light-emitting element EL. As a result, most of the video signal Vsig is written to the pixel capacitor Cs. To be exact, the potential difference Vsig−Vss1 is written to the pixel capacitor Cs. Therefore, the voltage Vgs between the gate G and the source S of the drive transistor Trd is (Vsig−Vss1+Vth), which results from the addition of the sampled voltage Vsig−Vss1 to the voltage Vth detected and held in advance. When the potential Vss1 is defined as 0 V in order to simplify the following description, the voltage Vgs between the gate and source is Vsig+Vth as shown in the timing chart of FIG. 7. The sampling of the video signal Vsig is carried out until timing T7, at which the control signal WS is returned to the low level. That is, the period T5-T7 is equivalent to a sampling period.

At timing T6, which is prior to the timing T7 as the end of the sampling period, the control signal DS is turned to the low level, which turns on the switching transistor Tr4. Thus, the drive transistor Trd is coupled to the power supply Vcc, and therefore the pixel circuit enters an emission period from the non-emission period. During the period T6-T7, during which the sampling transistor Tr1 is still in the on-state and the switching transistor Tr4 is in the on-state, correction regarding the mobility of the drive transistor Trd is carried out. That is, in the present embodiment, mobility correction is implemented during the period T6-T7, in which later part of the sampling period overlaps with beginning part of the emission period. In the beginning part of the emission period for mobility correction, in fact, the light-emitting element EL is in the reverse biased state, and therefore emits no light. In the mobility correction period T6-T7, the drain current Ids flows through the drive transistor Trd while the gate G of the drive transistor Trd is fixed at the level of the video signal Vsig. If the relationship Vss1−Vth<VthEL is set, the light-emitting element EL is in the reverse biased state, and therefore exhibits not a diode characteristic but a simple capacitive characteristic. Accordingly, the current Ids flowing through the drive transistor Trd is written to the capacitor C resulting from coupling between the pixel capacitor Cs and the equivalent capacitor Coled of the light-emitting element EL (C=Cs+Coled). This writing raises the source potential (S) of the drive transistor Trd. This potential rise is indicated by ΔV in the timing chart of FIG. 7. The potential rise reduces, by ΔV, the voltage Vgs between the gate and source held in the pixel capacitor Cs, which therefore leads to a negative feedback. By negatively feeding back the output current Ids from the drive transistor Trd to the input voltage Vgs of the same drive transistor Trd, correction regarding the mobility p is allowed. Note that the negative feedback amount ΔV can be optimized by adjusting the time width t of the mobility correction period T6-T7.

At the timing T7, the control signal WS is switched to the low level, which turns off the sampling transistor Tr1. As a result, the gate G of the drive transistor Trd is isolated from the signal line SL. Since the application of the video signal Vsig is released, the gate potential G of the drive transistor Trd is permitted to rise, and therefore rises together with the source potential (S). During the rise, the voltage Vgs between the gate and source held in the pixel capacitor Cs is maintained at the value (Vsig−ΔV+Vth). In step with the rise of the source potential (S), the reverse biased state of the light-emitting element EL is eliminated. Therefore, the light-emitting element EL starts light emission actually due to flowing of the output current Ids thereto. The relationship at this time between the drain current Ids and the gate voltage Vgs is expressed by Equation 2, which is obtained by substituting Vsig−ΔV+Vth for Vgs in Equation 1.

$$Ids=k\mu(Vgs-Vth)^2=k\mu(Vsig-\Delta V)^2 \qquad \text{Equation 2}$$

In Equation 2, k=(½)(W/L)Cox. Equation 2 does not include the term Vth, which shows that the output current Ids supplied to the light-emitting element EL has no dependence on the threshold voltage Vth of the drive transistor Trd. Basically, the drain current Ids is determined by the signal voltage Vsig of the video signal. That is, the light-emitting element EL emits light with a luminance dependent upon the video signal Vsig. The voltage Vsig is corrected by the feedback amount ΔV. This correction amount ΔV functions to cancel the influence of the mobility μ, which is at the coefficient part in Equation 2. Therefore, the drain current Ids depends only on the video signal Vsig practically.

Subsequently, at timing T8, the control signal DS is switched to the high level and thus the switching transistor Tr4 is turned off, which ends light emission and the field. Simultaneously the next field starts, and therefore Vth correction operation, mobility correction operation, and light emission operation are repeated again.

Figure 8:
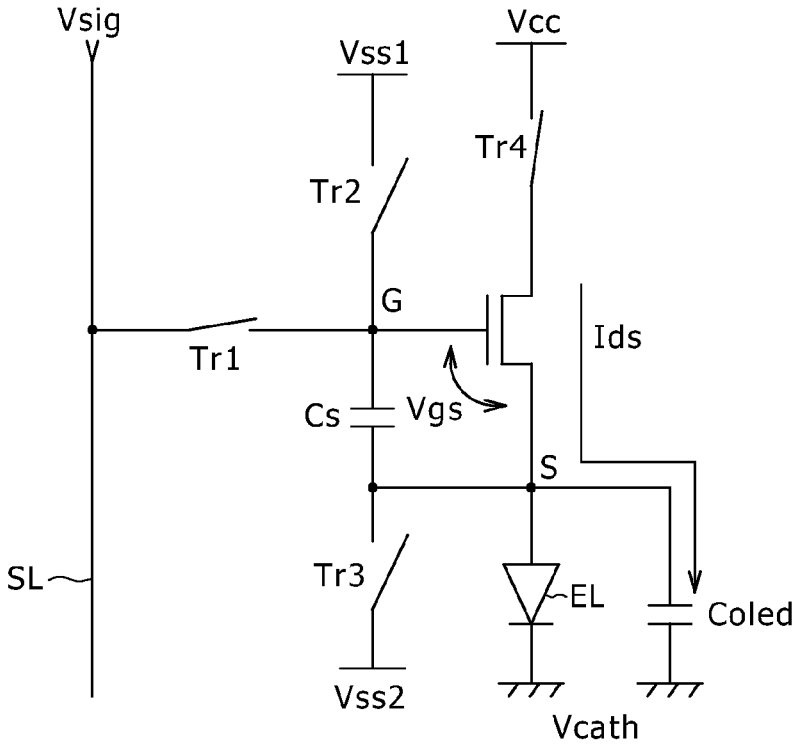
FIG. 8 is a schematic diagram for explaining the operation of the pixel circuit in FIG. 6.

FIG. 8 is a circuit diagram showing the state of the pixel circuit 2 in the mobility correction period T6-T7. Referring to FIG. 8, in the mobility correction period T6-T7, the sampling transistor Tr1 and the switching transistor Tr4 are in the on-state while the switching transistors Tr2 and Tr3 are in the off-state. In this state, the source potential (S) of the drive transistor Trd is Vss1−Vth. This source potential S is equal to the potential at the anode of the light-emitting element EL. If the relationship Vss1−Vth<VthEL is set as described above, the light-emitting element EL is in the reverse biased state, and therefore exhibits not a diode characteristic but a simple capacitive characteristic. Thus, the current Ids flowing through the drive transistor Trd flows into the combined capacitor between the pixel capacitor Cs and the equivalent capacitor Coled of the light-emitting element EL, i.e., into the capacitor C=Cs+Coled. That is, part of the drain current Ids is negatively fed back to the pixel capacitor Cs, which leads to correction regarding the mobility.

Figure 9:
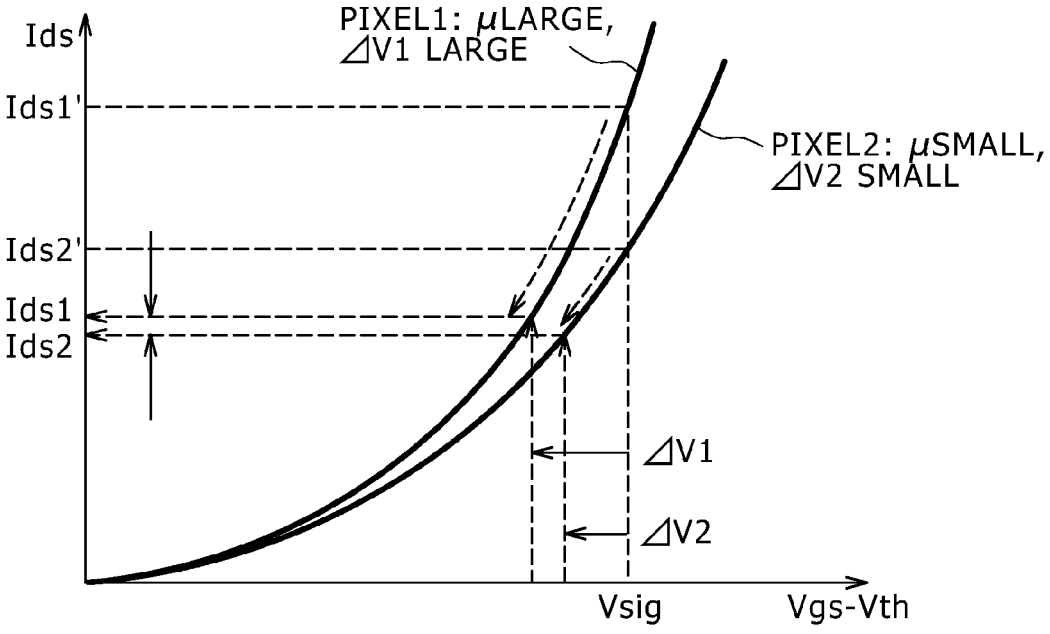
FIG. 9 is a graph for explaining the operation of the pixel circuit in FIG. 6.

FIG. 9 is a graph of Equation 2. The output current Ids is plotted on the ordinate and the voltage Vsig on the abscissa. Equation 2 is represented below this graph. The graph of FIG. 9 indicates two characteristic curves as a comparison between Pixel 1 and Pixel 2. The mobility p of the drive transistor in Pixel 1 is relatively large. In contrast, the mobility p of the drive transistor included in Pixel 2 is relatively small. If drive transistors are formed of a poly-silicon TFT or the like, it is inevitable that the mobility p thereof involves variation among pixels. When the same video signal Vsig is written to both Pixels 1 and 2 for example, no correction for the mobility results in a large difference between an output current Ids1' flowing in Pixel 1 having a large mobility p and an output current Ids2' flowing in Pixel 2 having a small mobility μ. Since large differences thus arise among the output currents Ids attributed to variation in the mobility μ, uniformity of a screen is deteriorated.

In order to address this problem, the present invention negatively feeds back the output current to the input voltage to thereby cancel variation in the mobility. As is apparent from the transistor characteristic equations, a larger mobility provides a larger drain current Ids. Therefore, the larger the mobility is, the larger the negative feedback amount ΔV is. As the graph of FIG. 9 shows, the negative feedback amount ΔV1 of Pixel 1 involving a large mobility μ is larger than the negative feedback amount ΔV2 of Pixel 2 involving a small mobility μ. This large negative feed back associated with a large mobility μ can suppress the variation. Specifically, as shown in FIG. 9, when the voltage is corrected by ΔV1 for Pixel 1 involving a large mobility μ, the output current thereof greatly decreases from Ids1' to Ids1. In contrast, since the correction amount ΔV2 for Pixel 2 involving a small mobility μ is small, the decrease of output current thereof, from Ids2' to Ids2, is relatively small. As a result, Ids1 and Ids2 are almost equal, and thus the variation in the mobility is cancelled. This mobility variation canceling is carried out across the entire range of the voltage Vsig, i.e., for entire gray-scales from black to white, which extremely enhances uniformity of a screen. As described above, when Pixel 1 involves a larger mobility than that of Pixel 2, the correction amount ΔV1 of Pixel 1 is larger than the correction amount ΔV2 of Pixel 2. That is, a larger mobility leads to a larger ΔV and therefore a larger decrease of Ids. Thus, the current values of pixels involving different mobilities are equalized, and therefore variation in the mobility can be corrected.

Figure 10:
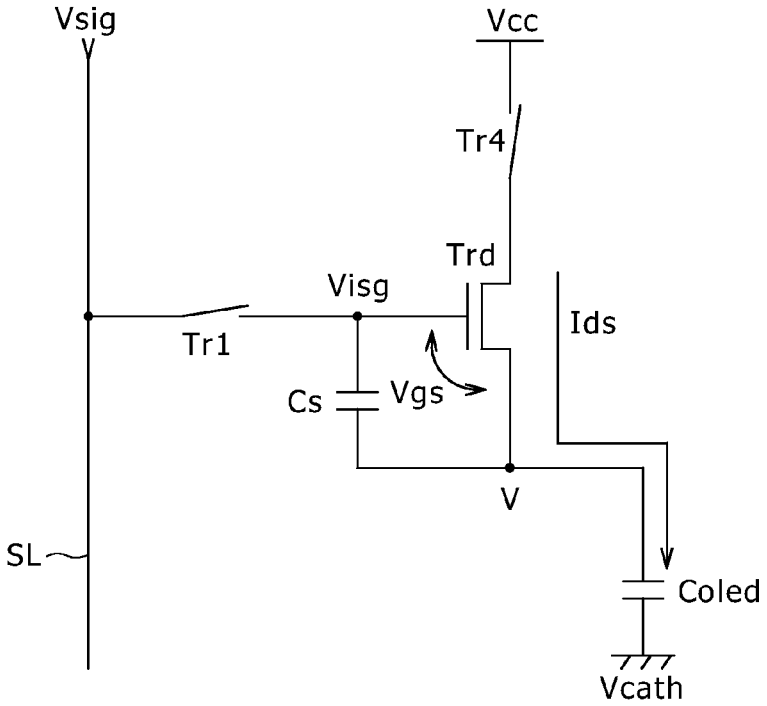
FIG. 10 is a schematic diagram for explaining the operation of the pixel circuit in FIG. 6.

For reference, the above-described mobility correction will be numerically analyzed with reference to FIG. 10. As shown in FIG. 10, the analysis will be carried out based on the potential, as a variable V, at the source of the drive transistor Trd when the transistors Tr1 and Tr4 are in the on-state. When the source potential (S) of the drive transistor Trd is defined as V, the drain current Ids following through the drive transistor Trd is expressed by Equation 3.

$$I_{ds}=k\mu(V_{gs}-V_{th})^2=k\mu(V_{sig}-V-V_{th})^2 \qquad \text{Equation 3}$$

In addition, the relationship between the drain current Ids and the capacitance C (=Cs+Coled) offers the formula Ids=dQ/dt=CdV/dt as indicated by Equation 4.

$$\begin{aligned} I_{ds} &= \frac{dQ}{dt} = C\frac{dV}{dt} \Leftrightarrow \int \frac{1}{C}dt = \int \frac{1}{I_{ds}}dV \\ &\Leftrightarrow \int_0^t \frac{1}{C}dt = \int_{-Vth}^{V} \frac{1}{k\mu(V_{sig}-V_{th}-V)^2}dV \\ &\Leftrightarrow \frac{k\mu}{C}t = \left[\frac{1}{V_{sig}-V_{th}-V}\right]_{-Vth}^{V} = \frac{1}{V_{sig}-V_{th}-V} - \frac{1}{V_{sig}} \\ &\Leftrightarrow V_{sig}-V_{th}-V = \frac{1}{\frac{1}{V_{sig}}+\frac{k\mu}{C}t} = \frac{V_{sig}}{1+V_{sig}\frac{k\mu}{C}t} \end{aligned} \qquad \text{Equation 4}$$

Equation 3 is substituted into Equation 4, which is then followed by integration of both sides of the resulting equation. The initial value of the source voltage V is −Vth. The time width of the period for correcting variation in the mobility (the period T6-T7) is defined as t. When the differential equation of Equation 4 is solved under these conditions, the pixel current expressed by Equation 5 is obtained as a function of the mobility correction time period t.

$$I_{ds} = k\mu\left(\frac{V_{sig}}{1 + V_{sig}\frac{k\mu}{C}t}\right)^2 \quad \text{Equation 5}$$

Figure 11:
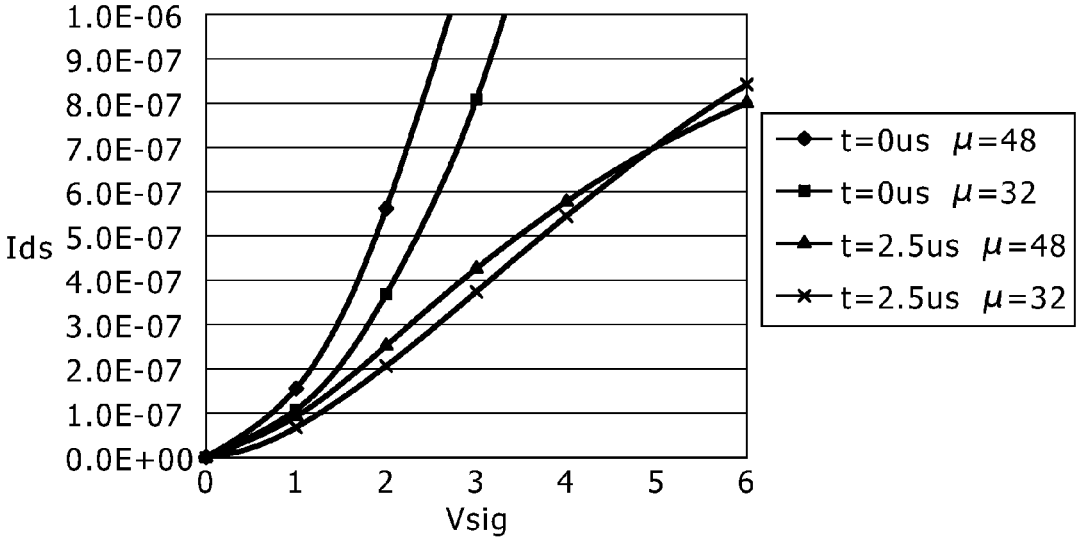
FIG. 11 is a graph showing the operating characteristics of drive transistors included in the pixel circuit in FIG. 6.

FIG. 11 is a graph showing the output current characteristic curves of pixels with different mobilities, obtained based on Equation 5. In the graph, the curves obtained when t=0 μs and 2.5 μs, respectively, are illustrated as to each pixel. FIG. 11 also indicates Equation 5 under the graph. Referring to FIG. 11, it is apparent that correction against mobility variation is effectively achieved when t=2.5 μs compared with when t=0 μs, i.e., when no mobility correction is implemented. The output current involves a variation of 40% when mobility correction is not implemented. In contrast, the variation is suppressed to 10% when mobility correction is implemented. At the time of mobility correction operation, the relationship V<VthEL must be ensured invariably. The pixel circuit of the above-described first embodiment employs, at the time of mobility correction, the pixel capacitance Cs and the equivalent capacitance Coled of the light-emitting element EL. Coled is larger than Cs, and therefore the combined capacitance C is also large, which can offer a margin of the mobility correction time period.

The above-described operation allows correction against mobility variation even in a pixel circuit that samples video signal potentials. Basically liquid crystal displays that have been put into practical use are driven by a voltage-driven method in which video signal potentials are sampled. If organic EL panels are allowed to correct mobility variation with use of a voltage-driven method, the organic EL panels can employ an external source driver or a source driver incorporated in a panel and formed of low-temperature poly-silicon TFTs and the like, which is used in liquid crystal displays in related art. Therefore, organic EL panel modules can be fabricated at low costs. The pixel circuit of the first embodiment employs a mixture of N-channel and P-channel transistors as the switching transistors other than the drive transistor. However, each transistor may be either of N- and P-channel transistors.

Figure 12:
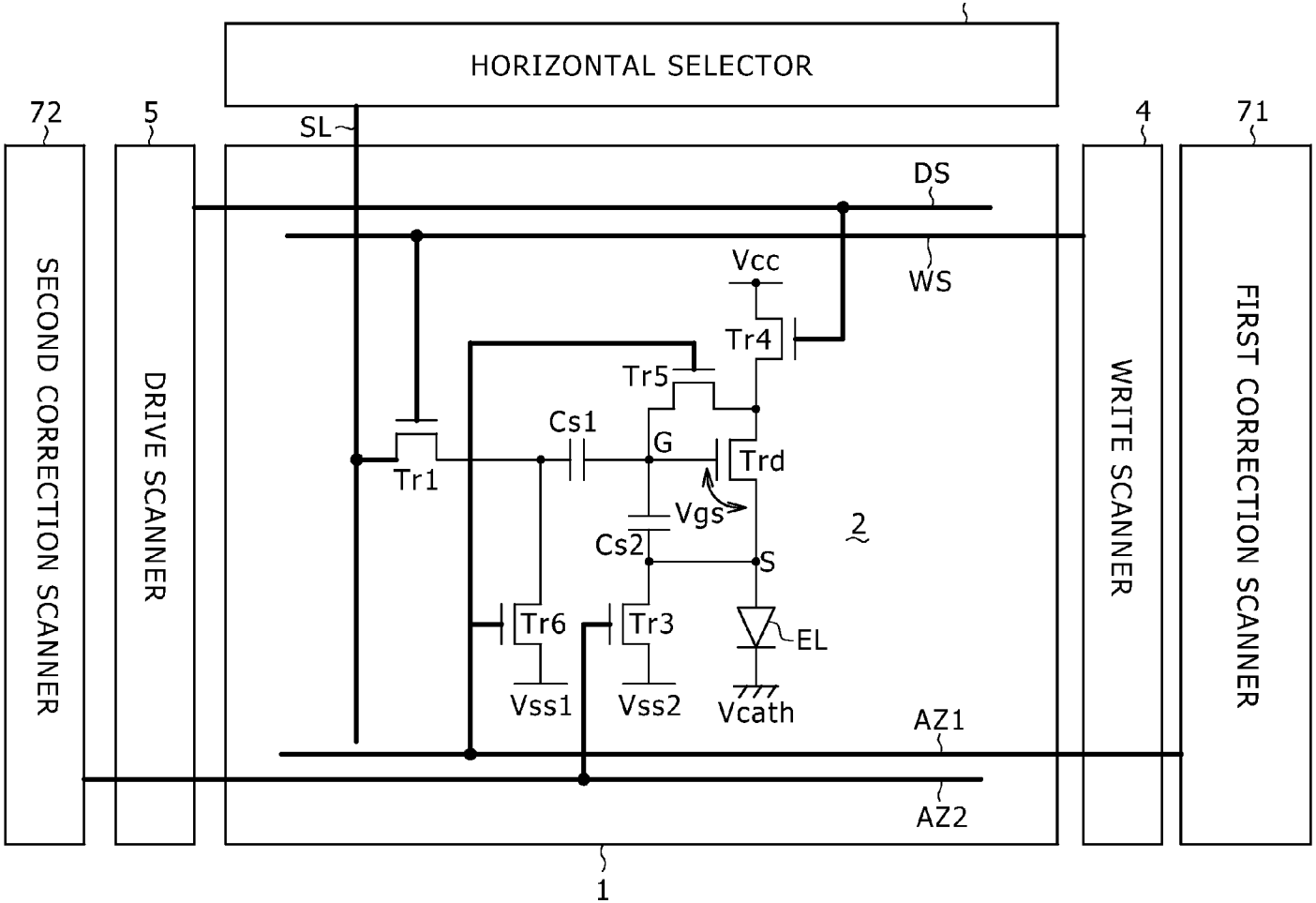
FIG. 12 is a block diagram illustrating a display according to a second embodiment of the present invention.

FIG. 12 is a circuit diagram illustrating a display according to a second embodiment of the present invention. In order to facilitate understanding, the same parts as those in the first embodiment of FIG. 5 are given the same numerals. This display includes the pixel array 1 and a peripheral circuit surrounding the pixel array 1. The peripheral circuit includes the horizontal selector 3, the write scanner 4, the drive scanner 5, the first correction scanner 71, and the second correction scanner 72. The pixel array 1 includes the pixel circuits 2 arranged in a matrix. For easy understanding, FIG. 12 illustrates only one pixel circuit 2. The pixel circuit 2 includes six transistors Tr1, Trd, and Tr3-Tr6, two capacitive elements Cs1 and Cs2, and one light-emitting element EL. All the transistors are an N-channel transistor. The gate G of the drive transistor Trd, which is a main part of the pixel circuit 2, is coupled to one end of each of the capacitive elements Cs1 and Cs2. One capacitive element Cs1 is a coupling capacitor that couples the output side and the input side of the pixel circuit 2. The other capacitive element Cs2 is a pixel capacitor to which a video signal is written via the coupling capacitor Cs1. The source S of the drive transistor Trd is coupled to the other end of the pixel capacitor Cs2 as well as to the light-emitting element EL. The light-emitting element EL is a diode device. The anode thereof is coupled to the source S of the drive transistor Trd while the cathode thereof is coupled to a ground potential Vcath. The switching transistor Tr3 is interposed between the source S of the drive transistor Trd and a certain reference potential Vss2. The gate of the transistor Tr3 is coupled to the scan line AZ2. The drain of the drive transistor Trd is coupled via the switching transistor Tr4 to the power supply Vcc. The gate of the switching transistor Tr4 is coupled to the scan line DS. In addition, the switching transistor Tr5 is interposed between the gate G and the drain of the drive transistor Trd. The gate of the transistor Tr5 is coupled to the scan line AZ1. The sampling transistor Tr1 on the input side is coupled between the signal line SL and the other end of the coupling capacitor Cs1. The gate of the sampling transistor Tr1 is coupled to the scan line WS. The switching transistor Tr6 is interposed between the other end of the coupling capacitor Cs1 and a certain reference potential Vss1. The gate of the transistor Tr6 is coupled to the scan line AZ1.

Figure 13:
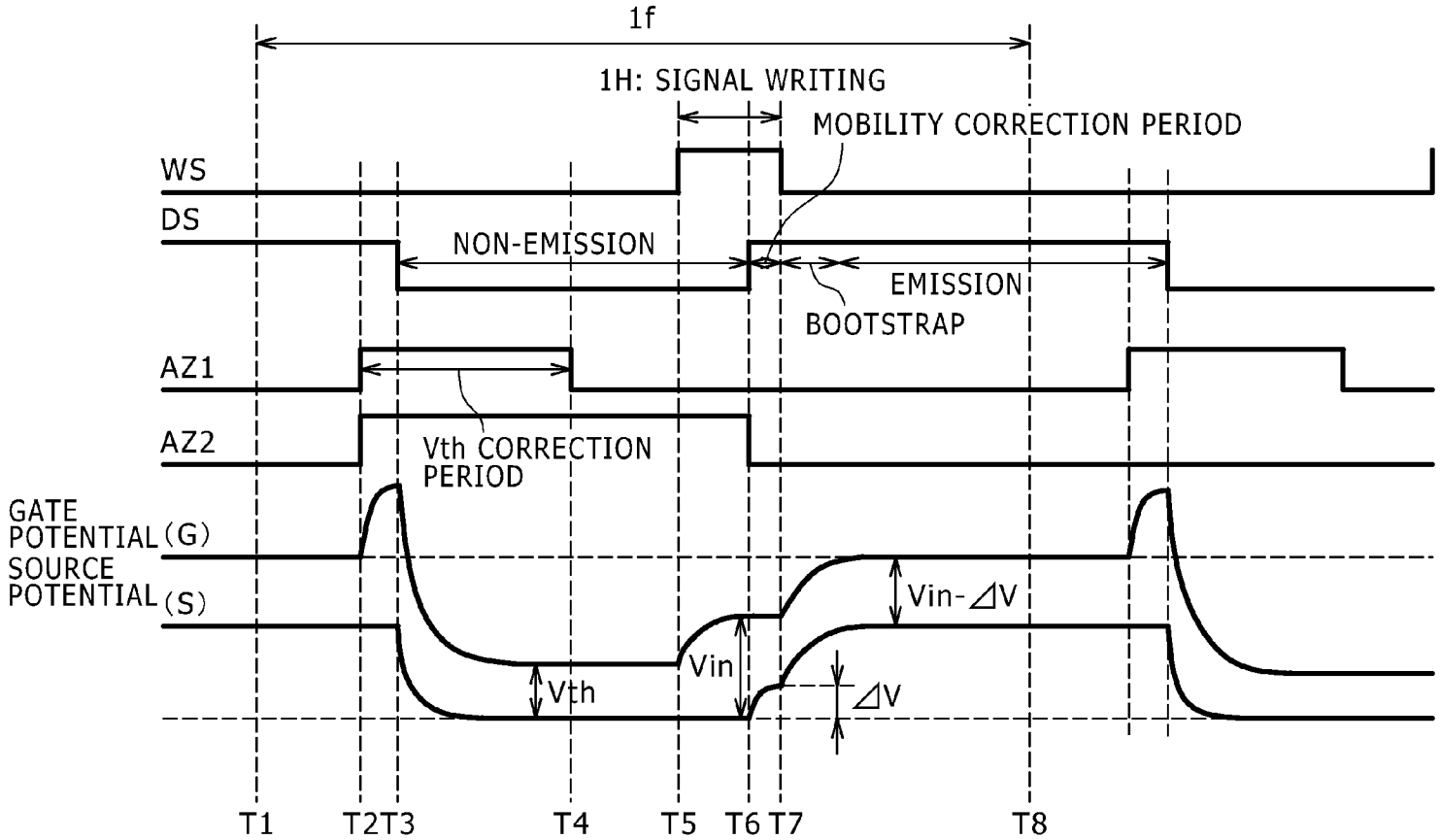
FIG. 13 is a timing chart for explaining the operation of the pixel circuit included in the display in FIG. 12.

FIG. 13 is a timing chart for explaining the operation of the pixel circuit of FIG. 12. FIG. 13 illustrates along a time axis T, the waveforms of the control signals WS, DS, AZ1 and AZ2, and also illustrates the changes of the gate potential (G) and source potential (S) of the drive transistor Trd. At timing T1, which corresponds to the start of a field, the control signals WS, AZ1 and AZ2 are at the low level while only the control signal DS is at the high level. Therefore, at the timing T1, only the switching transistor Tr4 is in the on-state, and the transistors Tr1, Tr3, Tr5 and Tr6 are in the off-state. At this time, since the drive transistor Trd is coupled to the power supply Vss via the switching transistor Tr4 in the on-state, a certain drain current Ids flows through the light-emitting element EL. Therefore, the pixel is in the emission state.

At timing T2, the control signals AZ1 and AZ2 are switched to the high level, which turns on the switching transistors Tr3, Tr5 and Tr6. Thus, the gate G of the drive transistor Trd is coupled via the transistor Tr5 to the power supply Vcc, which sharply raises the gate potential (G).

Subsequently, at timing T3, the control signal DS is turned to the low level and thus the transistor Tr4 is turned off. Since the power supply to the drive transistor Trd is stopped, the drain current Ids is attenuated. Thus, both the source potential (S) and gate potential (G) drop, and then the current disappears completely just when the potential difference between the both potentials becomes Vth. This voltage Vth is held in the pixel capacitor Cs2. The voltage Vth held in the pixel capacitor Cs2 is used to cancel the threshold voltage of the drive transistor Trd. At this time, since the switching transistor Tr3 is in the on-state, the source S of the drive transistor Tr2 is coupled via the transistor Tr3 to the reference potential Vss2. The potential Vss2 is set lower than the threshold voltage of the light-emitting element EL, and therefore the light-emitting element EL enters the reverse biased state.

Subsequently, at timing T4, the control signal AZ1 is switched to the low level, which turns off the transistors Tr5 and Tr6. Therefore, the voltage Vth written to the capacitor Cs2 is fixed. The period from the timing T2 to T4 is referred to as a Vth correction period (T2-T4). In the Vth correction period, the other end of the coupling capacitor Cs1 is held at the certain reference potential Vss1 since the transistor Tr6 is in the on-state.

At timing T5, the control signal WS is switched to the high level, which turns on the sampling transistor Tr1. As a result, the gate G of the drive transistor Trd is coupled to the signal line SL via the coupling capacitor Cs1 and the turned-on sampling transistor Tr1. Accordingly, the video signal is coupled via the coupling capacitor Cs1 to the gate G of the drive transistor Trd, which leads to a rise of the gate potential (G). In the timing chart of FIG. 13, the voltage resulting from the combination of the coupled video signal and the voltage Vth is indicated by Vin. The voltage Vin is held in the pixel capacitor Cs2. The control signal WS is returned to the low level at timing T7, which fixes the potential written to the pixel capacitor Cs2. The period T5-T7, during which the video signal is thus written via the coupling capacitor Cs1 to the pixel capacitor Cs2, is referred to as a sampling period. The length of the sampling period T5-T7 is equivalent to that of one horizontal period (1H).

In the present embodiment, at timing T6, which is prior to the timing T7 as the end of the sampling period, the control signal DS is switched to the high level while the control signal AZ2 is switched to the low level. As a result, the source S of the drive transistor Trd is isolated from the potential Vss2 while a current flows from the drain toward the source S. The gate potential (G) of the drive transistor Trd is kept at the video signal potential since the sampling transistor Tr1 is still in the on-state. Since an output current flows through the drive transistor Trd under such a state, the pixel capacitor Cs2 and the equivalent capacitor of the light-emitting element EL in the reverse biased state are charged. Thus, the source potential (S) of the drive transistor Trd rises by ΔV, and correspondingly the voltage Vin held in the capacitor Cs2 decreases. That is, the output current from the source S is negatively fed back to the input voltage of the gate G. The negative feedback amount is expressed by ΔV. This negative feedback operation allows correction regarding the mobility of the drive transistor Trd.

Thereafter, when the control signal WS is turned to the low level at the timing T7 and thus the application of the video signal is released, both the gate potential (G) and source potential (S) rise due to so-called bootstrap operation while keeping the potential difference therebetween at (Vin-ΔV). In step with the rise of the source potential (S), the reverse biased state of the light-emitting element EL is eliminated. Therefore, the output current Ids flows through the light-emitting element EL, which causes light emission thereof with a luminance dependent upon the video signal. Subsequently, at timing T8, the field if ends and simultaneously the next field starts. Also in the next field, Vth correction, signal writing, and mobility correction are implemented.

Figure 14:
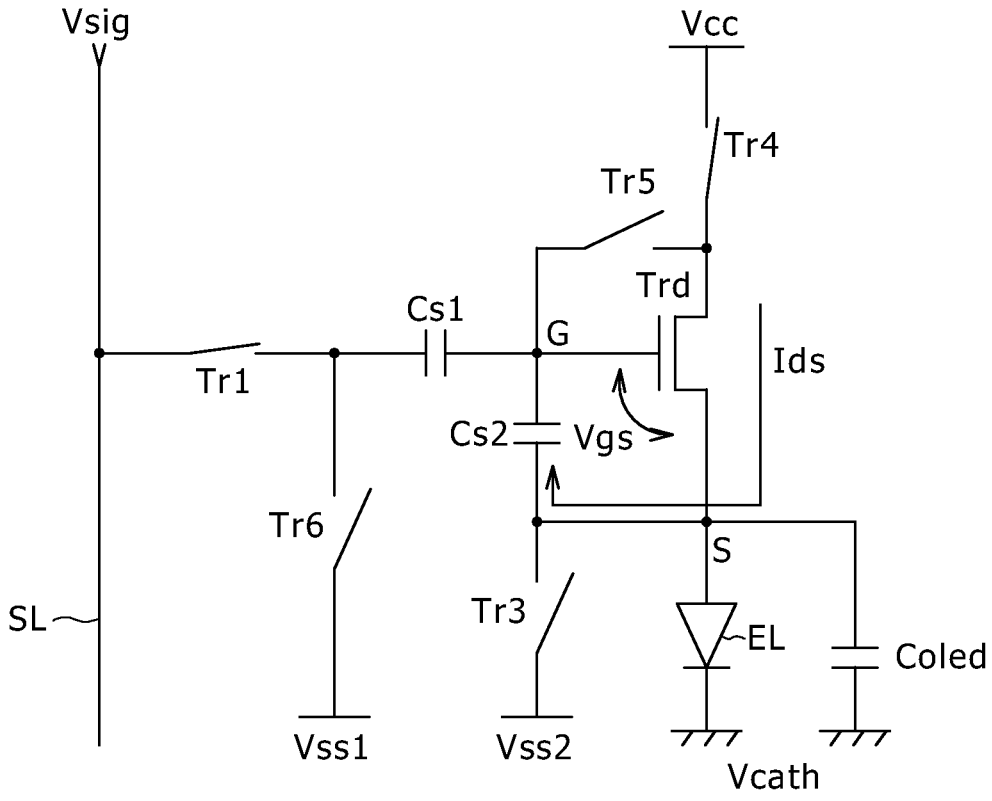
FIG. 14 is a circuit diagram for explaining the operation of the pixel circuit included in the display in FIG. 12.

FIG. 14 illustrates the state of the pixel circuit 2 in the mobility correction period T6-T7 shown in FIG. 13. This pixel circuit 2 also includes a correction unit formed of the switching transistors Tr3, Tr4 and Tr5 and so on. In order to cancel the dependence of the output current Ids on the carrier mobility p, the correction unit corrects in advance the input voltage Vin (Vgs) held in the pixel capacitor Cs2, before the emission period T6-T8 or at the beginning of the period T6-T8. Specifically, the correction unit operates during part of the sampling period T5-T7 in response to the control signals DS and AZ2 supplied from the scan lines DS and AZ2. Thus, the correction unit extracts the output current Ids from the drive transistor Trd while the video signal Vsig is sampled, and negatively feeds back the output current Ids to the pixel capacitor Cs2 to thereby correct the input voltage Vgs. In addition, in order to also cancel the dependence of the output current Ids on the threshold voltage Vth, this correction unit (Tr3, Tr4 and Tr5) detects the threshold voltage Vth of the drive transistor Trd and adds the detected threshold voltage Vth to the input voltage Vgs in advance, in the period T2-T4 prior to the sampling period T5-T7.

Also in the present embodiment, the drive transistor Trd is an N-channel transistor, and the drain thereof is coupled to the power supply Vcc while the source S thereof is coupled to the light-emitting element EL. In this configuration, the correction unit extracts the output current Ids from the drive transistor Trd and negatively feeds it back to the pixel capacitor Cs2, during the beginning part (T6-T7) of an emission period T6-T8. This beginning part overlaps with later part of the sampling period T5-T7. At this time, the correction unit causes the output current Ids extracted from the source S of the drive transistor Trd during the beginning part (T6-T7) of the emission period to flow to the equivalent capacitor Coled of the light-emitting element EL. The light-emitting element EL is a diode light-emitting element having an anode and a cathode, and the anode thereof is coupled to the source S of the drive transistor Trd while the cathode thereof is coupled to the ground potential Vcath. The correction unit sets the light-emitting element EL to be reverse biased in advance as described above, and utilizes the diode light-emitting element EL as the capacitive element Coled when the output current Ids extracted from the source S of the drive transistor Trd flows to the light-emitting element EL.

Figure 15:
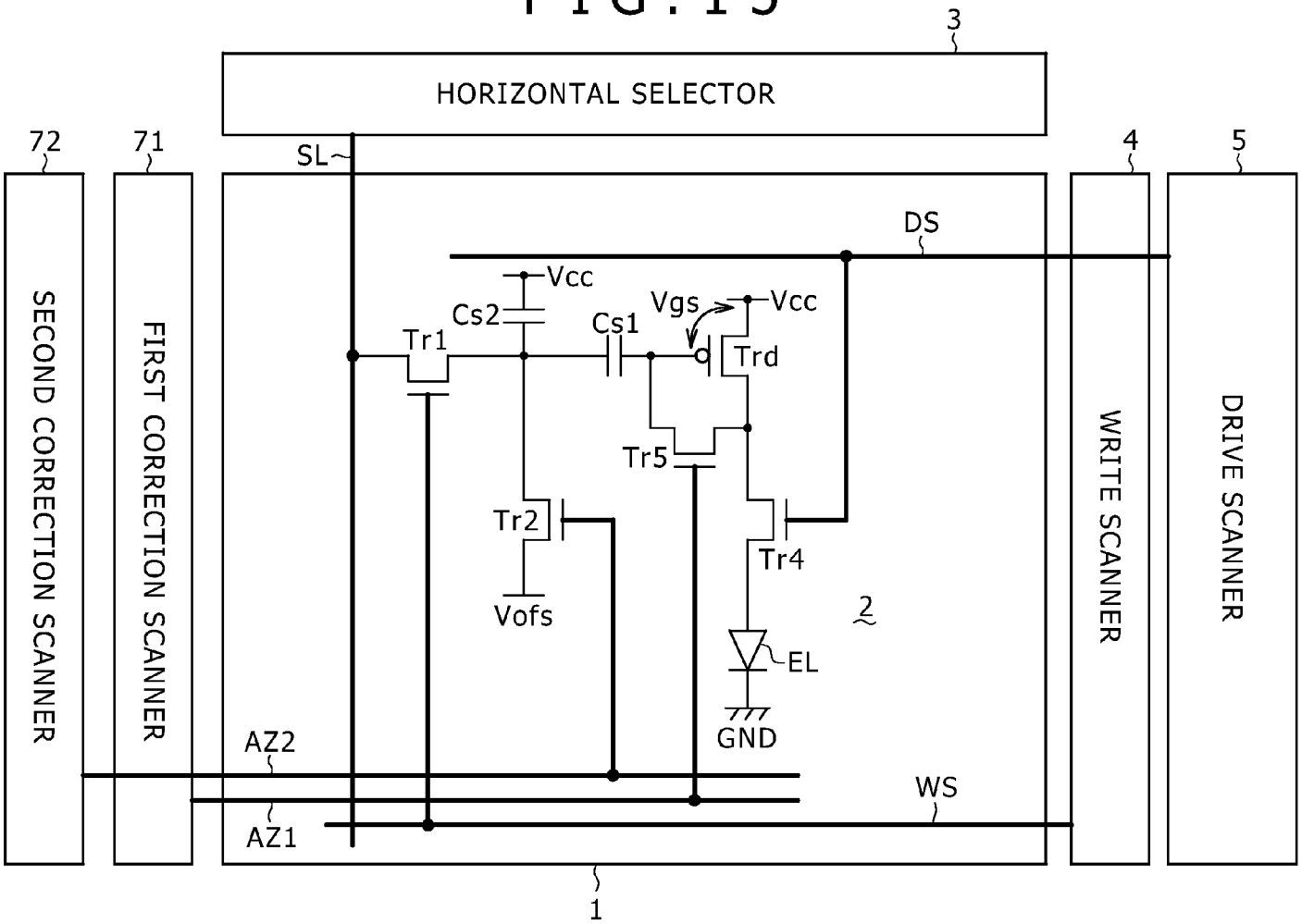
FIG. 15 is a block diagram illustrating a display according to a third embodiment of the present invention.

FIG. 15 is a block diagram illustrating a display according to a third embodiment of the present invention. In order to facilitate understanding, the same parts as those in the first embodiment of FIG. 5 are given the same numerals. This display also includes the central pixel array 1 and a peripheral circuit surrounding the pixel array 1. The peripheral circuit includes the horizontal selector 3, the write scanner 4, the drive scanner 5, the first correction scanner 71, and the second correction scanner 72. The pixel array 1 includes pixel circuits arranged in a matrix. For easy understanding, FIG. 15 illustrates only one pixel circuit 2 in a magnified form.

The pixel circuit 2 includes five transistors Tr1, Tr2, Tr4, Tr5 and Trd, two capacitive elements Cs1 and Cs2, and one light-emitting element EL. The drive transistor Trd is a P-channel transistor unlike the first and second embodiments. All of the remaining transistors Tr1, Tr2, Tr4 and Tr5 are an N-channel transistor. Although depending on the pixel size and the characteristics of the light-emitting element EL, typically an N-channel drive transistor offers a larger capacity of the mobility correction value, and therefore offers a margin of mobility correction, compared with a P-channel drive transistor.

The source of the drive transistor Trd is coupled to the power supply Vcc. The gate thereof is coupled to one end of a pixel capacitor Cs1. When the drive transistor Trd is a P-channel transistor, the gate voltage Vgs is defined based on the supply potential Vcc, which is the potential at the source. The drain of the drive transistor Trd is coupled via the switching transistor Tr4 to the light-emitting element EL. The light-emitting element EL is a diode light-emitting element. The anode thereof is coupled via the switching transistor Tr4 to the drain of the drive transistor Trd while the cathode thereof is grounded. The gate of the switching transistor Tr4 is coupled to the scan line DS. The switching transistor Tr5 is interposed between the gate and drain of the drive transistor Trd. The gate thereof is coupled to the scan line AZ1.

The sampling transistor Tr1, which is on the input side of the pixel circuit 2, is coupled between the signal line SL and the other end of the pixel capacitor Cs1. The gate of the sampling transistor Tr1 is coupled to the scan line WS. Another pixel capacitor Cs2 is coupled between the other end of the pixel capacitor Cs1 and the power supply Vcc. The switching transistor Tr2 is coupled between the other end of the pixel capacitor Cs1 and a certain offset potential Vofs. The gate of the transistor Tr2 is coupled to the scan line AZ2.

Figure 16:
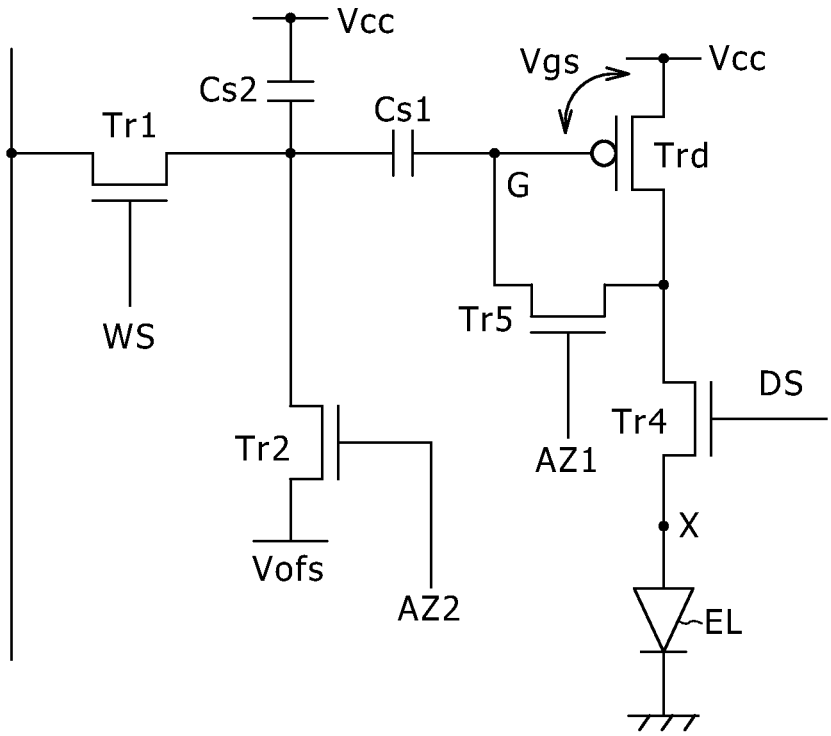
FIG. 16 is a schematic diagram for explaining the operation of the pixel circuit included in the display in FIG. 15.

FIG. 16 is a circuit diagram clearly specifying the relationships between the transistors in the pixel circuit in FIG. 15 and the corresponding control signals. In addition, the gate of the drive transistor Trd is indicated by G, and the anode of the light-emitting element EL is indicated by X. Each control signal applied to the gate of a respective one of the transistors Tr1, Tr2, Tr4 and Tr5 is given the same sign as that of the corresponding scan line.

Figure 17:
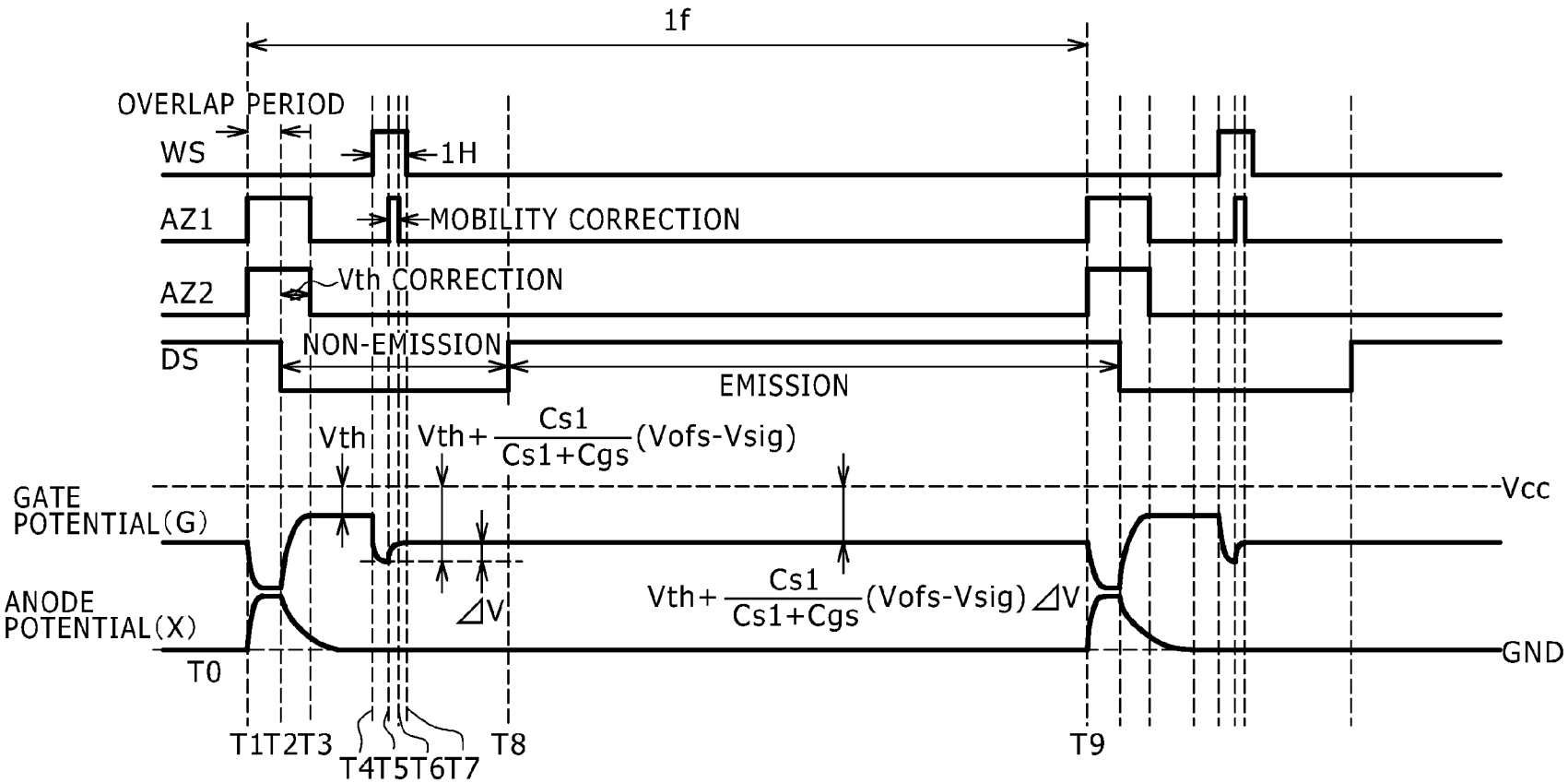
FIG. 17 is a timing chart for explaining the operation of the pixel circuit included in the display in FIG. 15.

FIG. 17 is a timing chart for explaining the operation of the pixel circuit of FIG. 16. FIG. 17 illustrates along a time axis T, the waveforms of the control signals WS, AZ1, AZ2 and DS, and also illustrates the changes of the gate potential (G) of the drive transistor Trd and the anode potential (X) of the light-emitting element EL.

At timing T0, which is prior to the start of a field, the control signals WS, AZ1 and AZ2 are at the low level while the control signal DS is at the high level. Therefore, at the timing T0, only the switching transistor Tr4 is in the on-state while the transistors Tr1, Tr2 and Tr5 are in the off-state. The drive transistor Trd is coupled to the light-emitting element EL via the switching transistor Tr4 in the on-state. Therefore, an output current dependent upon the gate voltage Vgs flows through the light-emitting element EL, and thus the pixel is in the emission state. Note that the timing chart of FIG. 17 indicates the gate voltage Vgs by the potential difference between the supply potential Vcc and the gate potential (G).

At timing T1, which corresponds to the start of the field, the control signals AZ1 and AZ2 are turned to the high level, which turns on the transistors Tr2 and Tr5. Thus, the other end of the pixel capacitor Cs1 is fixed at the certain offset potential Vofs. Furthermore, the drain and gate of the drive transistor Trd are directly coupled to each other. Therefore, the gate potential (G) sharply drops by being drawn to the drain potential. In contrast, the anode potential (X) sharply rises due to a voltage drop generated in the light-emitting element EL. This operation causes the drive transistor Trd to enter a preparation state for threshold voltage detection.

Subsequently, at timing T2, the control signal DS is turned to the low level and thus the switching transistor Tr4 is turned off. The period T1-T2 is referred to as a reset period or an overlap period. The turning off of the switching transistor Tr4 cuts off the current path from the drive transistor, and therefore the gate capacitor Cgs and the pixel capacitor Cs1 are charged. As a result, the gate potential (G) rises. The drive transistor Trd is cut off just when the potential difference between the supply potential Vcc and the gate potential (G) becomes Vth. At timing T3, which is after the cut-off, the control signals AZ1 and AZ2 are returned to the low level, which turns off the transistors Tr2 and Tr5. As a result, the threshold voltage Vth written to the pixel capacitor Cs1 is fixed. The period T2-T3 is referred to as a Vth correction period or a Vth detection period. Since energization to the light-emitting element EL is interrupted, the anode potential (X) drops to the ground potential GND.

Subsequently, at timing T4, the control signal WS is switched to the high level, which turns on the sampling transistor Tr1. As a result, the video signal Vsig is sampled, and therefore the voltage Vofs−Vsig is written to the pixel capacitor Cs2. This voltage Vofs−Vsig is coupled via the pixel capacitor Cs1 to the gate G of the drive transistor Trd. The coupled voltage amount is expressed as Cs1(Vofs−Vsig)/(Cs1+Cgs). Note that Cgs denotes the capacitance between the source and gate of the drive transistor. The gate potential (G) drops by this coupled voltage amount. Accordingly, the gate voltage Vgs becomes the voltage Vth+Cs1(Vofs−Vsig)/(Cs1+Cgs). At timing T7 after the elapse of one horizontal period (1H), the control signal WS is returned to the low level and thus the sampling transistor Tr1 is turned off. The sampling of the video signal Vsig is carried out during the period T4-T7, which corresponds to 1H.

During the period T5-T6, which is part of the sampling period T4-T7, the control signal AZ1 is switched to the high level, which turns on the transistor Tr5. As a result, a drain current flows from the power supply Vcc (the source of the drive transistor Trd) through the drain to the gate G. This flowing of the drain current raises the gate potential (G) by a voltage ΔV. The voltage ΔV is proportional to the mobility of the drive transistor. When the drive transistor involves a larger mobility, a larger voltage ΔV is obtained and thus a larger rise of the gate potential (G) is achieved. Thus, a larger reduction of the gate voltage Vgs is achieved correspondingly, which allows greater suppression of the output current. By thus negatively feeding back the output current from the drain of the drive transistor Trd to the gate thereof, variation in the mobility can be corrected. The period T5-T6, which is set within the sampling period T4-T7, is referred to as a mobility correction period. As a result of the mobility correction, the gate voltage Vgs of the drive transistor Trd becomes Vth+Cs1(Vofs−Vsig)/(Cs1+Cgs)−ΔV. The gate voltage Vgs includes, in addition to the primary signal component, the component Vth for canceling the threshold voltage of the drive transistor and the component ΔV for canceling the mobility of the drive transistor.

At timing T8, the control signal DS is switched to the high level, which turns on the switching transistor Tr4. Thus, the drive transistor Trd is directly coupled to the light-emitting element EL, and an output current of which variation due to the variation in the threshold voltage Vth and the mobility μ has been corrected flows through the light-emitting element EL. Thereafter, at timing T9, the field ends and simultaneously the next field starts. Also in the next field, Vth correction, video signal sampling, and mobility correction are implemented.

Figure 18:
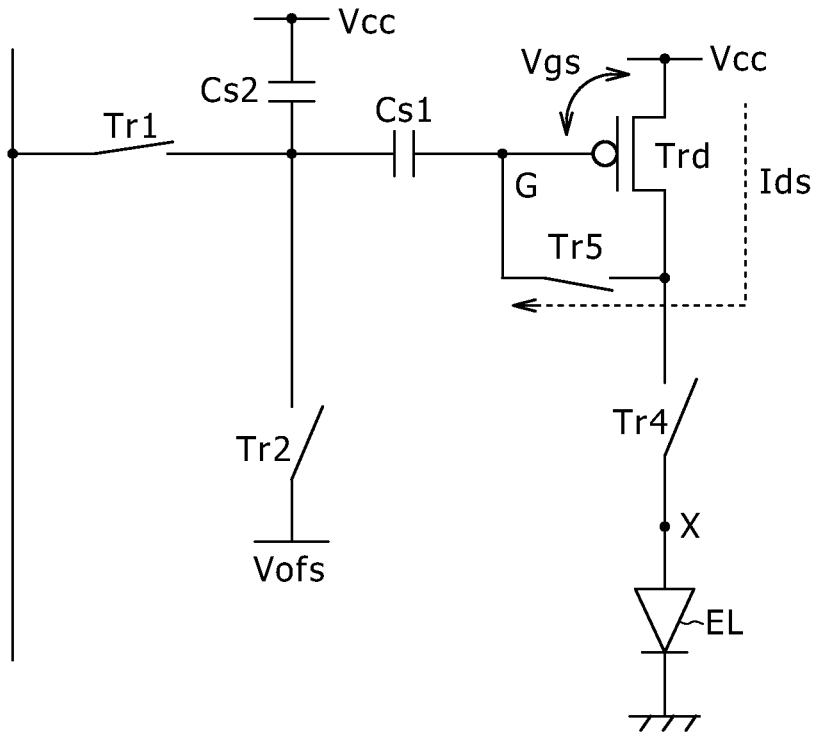
FIG. 18 is a schematic diagram for explaining the operation of the pixel circuit included in the display in FIG. 15.

FIG. 18 is a circuit diagram showing the state of the pixel circuit in the mobility correction period T5-T6. Since the sampling transistor Tr1 and the switching transistor Tr5 are in the on-state in the mobility correction period T5-T6 as described above, the drain current Ids is written to the pixel capacitor Cs1. This writing raises the gate potential (G) of the drive transistor Trd by the voltage ΔV. The drain current Ids flowing at this time is expressed by Equation 6. In Equation 6, the coupling coefficient Cs1/(Cs1+Cgs) is approximated as 1 and thus is omitted. In practice, CS1 is considerably larger compared with Cgs.

$$I_{ds}=k\mu(V_{gs}-V_{th})^2=k\mu(V_{ofs}-V_{sig}-\Delta V)^2 \quad \text{Equation 6}$$

Since the formula ΔV=Ids·t/Cs1 is obtained, pixels with different mobilities involve different voltages ΔV as described above. A pixel with a larger mobility involves a larger voltage ΔV, and therefore obtains a larger correction amount of the current Ids. Due to the mobility correction operation, the output currents of pixels involving variation in the mobility can be equalized, i.e., variation in the mobility can be corrected.

A detailed formula for the output current is achieved as expressed by Equation 7, through a similar analysis to that in the first embodiment.

$$I_{ds} = k\mu\left(\frac{V_{ofs} - V_{sig}}{1 + (V_{ofs} - V_{sig})\frac{k\mu}{Cs_1}t}\right)^2 \quad \text{Equation 7}$$

The right hand side of Equation 7 includes two mobilities μ. The mobility μ in the coefficient part and the mobility μ in the denominator of the fraction part cancel each other. Accordingly, the dependence on the mobility μ can be removed from the drive current Ids. The mobility μ in the denominator can be adjusted by controlling the time width t of the mobility correction period T5-T6. Thus, the mobility correction in the embodiments of the present invention can be optimized.

While the preferred embodiments of the present invention have been described using the specific terms, such description is for illustrative purposes only, and it is to be understood that changes and variations may be made without departing from the spirit or scope of the following claims.

What is claimed is:

1. A method of driving a display that includes a pixel array part, a scanner part, and a selector part, the pixel array part including scan lines, signal lines, first potential lines supplying a potential $V_{CC}$, second potential lines supplying a potential $V_{ofs}$, and a matrix of pixels, the selector part supplying a video signal $V_{sig}$ to the signal lines, the scanner part supplying a control signal to the scan lines to sequentially scan the pixels, at least one of the pixels including a sampling transistor, a first capacitor, a drive transistor, a first switching transistor, a second switching transistor and a light-emitting element, the method comprising:

initializing a potential difference of the capacitor to $V_{CC}-V_{ofs}$ to supply $V_{CC}$ from the first potential line and $V_{ofs}$ from the second potential line;

causing the potential difference of the capacitor to approach a threshold voltage $V_{th}$ of the drive transistor to flow a correction current via the drive transistor;

setting the potential of the gate of the driving transistor to $V_{sig}-V_{th}$ via the sampling transistor; and supplying an emitting current to the light-emitting element via the second switching transistor and the drive transistor, wherein the sampling transistor, the drive transistor, the first switching transistor, and the second switching transistor are p-channel type transistors, and wherein the light-emitting element is configured to emit light with a luminance dependent upon $V_{CC}-V_{sig}$.

2. The method according to claim 1, wherein the light-emitting element is configured to emit light with a luminance dependent upon $V_{CC}-V_{sig}$ and a mobility of the drive transistor.

3. The method according to claim 1, wherein the second switching transistor is in a conductive state when the first switching transistor begins to supply $V_{ofs}$ to the gate of the drive transistor.

* * * * *